US007255535B2

(12) United States Patent
Albrecht et al.

(10) Patent No.: US 7,255,535 B2
(45) Date of Patent: Aug. 14, 2007

(54) COOLING SYSTEMS FOR STACKED LAMINATE CMC VANE

(76) Inventors: Harry A. Albrecht, 9036 SE. Mars St., Hobe Sound, FL (US) 33455; Yevgeniy Shteyman, 5600 N. Flagler Dr., #2707, West Palm Beach, FL (US) 33407; Steven James Vance, 4014 Coralbrooke Grove, Orlando, FL (US) 32826; Jay A. Morrison, 2413 Ekana Dr., Oviedo, FL (US) 32765

( * ) Notice: Subject to any disclaimer, the term of this patent is extended or adjusted under 35 U.S.C. 154(b) by 190 days.

(21) Appl. No.: 11/002,030

(22) Filed: Dec. 2, 2004

(65) Prior Publication Data

US 2007/0140835 A1 Jun. 21, 2007

(51) Int. Cl.
*F01D 5/18* (2006.01)
*F01D 5/14* (2006.01)

(52) U.S. Cl. ..... 416/97 R; 416/229 R; 416/241 B

(58) Field of Classification Search ..... 416/97 R, 416/229 R, 232, 241 B, 243; 415/115
See application file for complete search history.

(56) References Cited

U.S. PATENT DOCUMENTS

| | | | | |
|---|---|---|---|---|
| 3,301,526 | A | | 1/1967 | Chamberlain |
| 3,378,228 | A | | 4/1968 | Davies et al. |
| 3,515,499 | A | | 6/1970 | Beer et al. |
| 3,554,663 | A | | 1/1971 | Helms |
| 3,584,972 | A | | 6/1971 | Bratkovich |
| 3,606,573 | A | | 9/1971 | Emmerson et al. |
| 3,619,077 | A | | 11/1971 | Wile et al. |
| 3,698,834 | A | | 10/1972 | Meginnis |
| 3,778,183 | A | | 12/1973 | Luscher et al. |
| 3,872,563 | A | | 3/1975 | Brown et al. |
| 4,105,364 | A | | 8/1978 | Dodd |
| 4,180,371 | A | | 12/1979 | Ivanko |
| 4,221,539 | A | | 9/1980 | Corrigan |
| 4,260,326 | A | | 4/1981 | Scott et al. |
| 4,314,794 | A | | 2/1982 | Holden et al. |
| 4,347,037 | A | * | 8/1982 | Corrigan ..... 416/97 A |
| 4,504,189 | A | | 3/1985 | Lings |
| 4,697,985 | A | * | 10/1987 | Suzuki ..... 416/97 R |
| 4,770,608 | A | | 9/1988 | Anderson et al. |
| 5,306,554 | A | | 4/1994 | Harrison et al. |
| 5,702,232 | A | | 12/1997 | Moore |
| 6,206,638 | B1 | | 3/2001 | Glynn et al. |
| 6,224,339 | B1 | | 5/2001 | Rhodes et al. |
| 6,235,370 | B1 | | 5/2001 | Merrill et al. |

(Continued)

FOREIGN PATENT DOCUMENTS

EP 0140257 A1 5/1985

(Continued)

*Primary Examiner*—Edward K. Look
*Assistant Examiner*—Nathan Wiehe

(57) ABSTRACT

Embodiments of the invention relate to various cooling systems for a turbine vane made of stacked ceramic matrix composite (CMC) laminates. Each airfoil-shaped laminate has an in-plane direction and a through thickness direction substantially normal to the in-plane direction. The laminates have anisotropic strength characteristics in which the in-plane tensile strength is substantially greater than the through thickness tensile strength. Such a vane construction lends itself to the inclusion of various cooling features in individual laminates using conventional manufacturing and forming techniques. When assembled in a radial stack, the cooling features in the individual laminates can cooperate to form intricate three dimensional cooling systems in the vane.

8 Claims, 18 Drawing Sheets

U.S. PATENT DOCUMENTS

| | | | | |
|---|---|---|---|---|
| 6,322,322 | B1 | 11/2001 | Rhodes et al. | |
| 6,390,774 | B1 | 5/2002 | Lewis et al. | |
| 6,398,501 | B1 | 6/2002 | Darkins, Jr. et al. | |
| 6,478,535 | B1 | 11/2002 | Chung et al. | |
| 6,506,022 | B2 | 1/2003 | Bunker | |
| 6,574,966 | B2 | 6/2003 | Hidaka et al. | |
| 6,589,010 | B2 | 7/2003 | Itzel et al. | |
| 6,648,600 | B2 | 11/2003 | Takahashi et al. | |
| 6,670,046 | B1 | 12/2003 | Xia | |
| 6,769,866 | B1 * | 8/2004 | Kannefass et al. | 415/115 |
| 2003/0059305 | A1 | 3/2003 | Bather et al. | |

FOREIGN PATENT DOCUMENTS

| | | | |
|---|---|---|---|
| EP | 1001137 | A2 | 5/2000 |
| EP | 1065343 | A2 | 1/2001 |
| EP | 1091092 | A2 | 4/2001 |
| EP | 1239119 | A1 | 9/2002 |
| EP | 1245786 | A2 | 10/2002 |
| EP | 1267038 | A2 | 12/2002 |
| EP | 1319803 | A2 | 6/2003 |
| EP | 1361337 | A1 | 11/2003 |
| EP | 1367223 | A2 | 12/2003 |
| JP | 59113204 | A2 | 6/1984 |
| WO | WO 00/53896 | * | 9/2000 |
| WO | WO 01/12361 | A2 | 2/2001 |
| WO | WO 03/026887 | A2 | 4/2003 |
| WO | WO 03/042503 | A1 | 5/2003 |

* cited by examiner

COOLING SYSTEMS FOR STACKED LAMINATE CMC VANE

FIELD OF THE INVENTION

The invention relates in general to turbine engines and, more specifically, to cooling systems for stationary airfoils in a turbine engine.

BACKGROUND OF THE INVENTION

During the operation of a turbine engine, turbine vanes, among other components, are subjected to the high temperatures of combustion. The vanes can be made of materials that are suited for high temperature applications, such as composite matrix composites (CMC). However, material selection alone will not enable the vanes to withstand such an environment. The vanes need to be cooled. Though a variety of systems can adequately cool a vane, manufacturing capabilities and other considerations can render a number of cooling systems infeasible or otherwise not possible in a CMC vane. Thus, there is a need for a CMC vane construction that facilitates the inclusion of intricate three dimensional cooling passages using relatively conventional manufacturing and assembly techniques.

SUMMARY OF THE INVENTION

Aspects of the invention relate to a turbine vane assembly having a first cooling system. The vane is formed by a radial stack of laminates that have an airfoil-shaped outer periphery. The vane has a planar direction and a radial direction; the radial direction is substantially normal to the planar direction. Each of the laminates is made of an anisotropic CMC material such that the planar tensile strength of the vane is substantially greater than the radial tensile strength of the vane. The vane can include an outer peripheral surface, which can be substantially covered by a thermal insulating material.

One or more first laminates have a outer airfoil-shaped wall enclosing an inner wall. The inner wall, which can be airfoil-shaped, encloses a central opening that defines a plenum. The inner wall is spaced from the outer wall so as to define a cooling passage therebetween. The spacing between the outer and inner walls in the first laminate can be substantially constant. Alternatively, the spacing between the outer and inner walls can be substantially constant in a forward portion of the laminate and increase in at least a part of the aft portion of the laminate. In such case, the laminate can have a substantially hollow trailing edge.

The inner wall is connected to the outer wall by at least one rib. The rib divides the cooling passage into a set of discrete cooling passages. The plenum can be in fluid communication with one or more of the discrete cooling passages through one or more supply openings provided in the inner wall. In one embodiment, the supply opening can be provided near either the trailing edge or the leading edge of the laminate. During engine operation, the vane can have a pressure side and a suction side. In one embodiment, the ribs can be provided solely on the suction side of the laminates.

One or more of the laminates can include a discharge opening extending through the outer wall of the laminate and substantially in the planar direction. The discharge opening can extend from one of the cooling passages and out the trailing edge of the laminate. As a result, a coolant in the cooling passages can be discharged from the vane assembly at the trailing edge of the vane.

The stack of laminates can further include a second laminate. The second laminate can have a outer airfoil-shaped wall that encloses an inner wall, which may be airfoil-shaped. The inner wall can be spaced from the outer wall so as to define a cooling passage therebetween. The inner wall can be joined to the outer wall by one or more ribs. These ribs can divide the cooling passage into a set of discrete cooling passages. The inner wall can include a central opening that defines a plenum. When a second laminate is provided, the vane can be formed by an alternating arrangement of the first laminates and the second laminates. The cooling passages in the first laminates can offsettingly overlap the cooling passages in the second laminate so as to be in fluid communication. Thus, a weaved cooling path can be established within the vane.

In another respect, aspects of the invention relate to a turbine vane assembly having a second cooling system. The vane is formed by a radial stack of laminates that have an airfoil-shaped outer periphery. The outer periphery of the laminates can form in part the outer peripheral surface of the vane. The vane has a planar direction and a radial direction. The radial direction is substantially normal to the planar direction. The laminates are made of an anisotropic ceramic matrix composite (CMC) material such that the planar tensile strength of the vane is substantially greater than the radial tensile strength of the vane.

The stack of laminates includes alternating large laminates and small laminates. The large laminates peripherally overhang the small laminates about the entire outer periphery of the small laminate. Consequently, a series of recesses are formed about the outer peripheral surface of the vane. Each recess is defined by the outer peripheral edge of at least one small laminate and the adjacent overhanging portions of two large laminates. An outer covering is secured to the outer peripheral surface of the vane so as to close the recesses to form a series of cooling channels extending about the outer peripheral surface of the vane.

The outer covering can be a thermal insulating material. Alternatively, the outer covering can be a CMC wrap. The fibers of the CMC wrap can be oriented so as to be substantially parallel to the outer peripheral surface of the vane. In one embodiment, the CMC wrap can be substantially surrounded by a thermal insulating material.

The laminates can include radial cutouts so as to form a coolant supply plenum in the vane. The coolant supply plenum can be in fluid communication with the series of cooling channels. Thus, a coolant introduced in the coolant supply plenum can flow into the series of cooling channels so as to cool the outer peripheral surface of the vane. The vane can have a leading edge and a trailing edge. In one embodiment, the plenum can be provided in the laminate substantially adjacent the leading edge. One or more exit passages can extend from the cooling channel through the outer covering and out the trailing edge of the vane. As a result, coolant can be dumped at the trailing edge after the coolant has passed through the cooling channels.

Aspects of the invention further relate to a turbine vane having a third cooling system. The vane is formed by a radial stack of laminates. Each laminate has an airfoil-shaped outer periphery. The outer periphery transitions from a forward portion that includes a leading edge to an aft portion that includes a trailing edge. The vane has a planar direction and a radial direction; the radial direction is substantially normal to the planar direction. Each of the laminates is made of an anisotropic CMC material such that the planar tensile strength of the vane is substantially greater than the radial tensile strength of the vane.

The radial stack of laminates include at least a first laminate and an adjacent second laminate. The first laminate has a series of cooling slots in the aft portion of the laminate. The cooling slots extend radially through the first laminate. The second laminate has a series of cooling slots in the aft portion of the laminate. The cooling slots extending radially through the second laminate. The cooling slots in the first laminate are overlappingly offset from the cooling slots in the second laminate so as to be in fluid communication with at least one slot in the second laminate. Thus, a tortuous coolant path is created in the aft portion of the vane such that a coolant must move in the planar and radial directions through the vane assembly.

In one embodiment, the final cooling slot in the first laminate can open to the trailing edge of the laminate, and the final cooling slot in the second laminate can terminate prior to the trailing edge of the second laminate. Thus, a coolant traveling through the overlapping cooling slots can exit the vane through the final slot in the first laminate.

A series of cooling slots can be provided in the forward portion of the first laminate. The cooling slots can extend radially through the first laminate. The cooling slots can be proximate to and can generally follow the outer peripheral surface of the first laminate. Similarly, a series of cooling slots can be provided in the forward portion of the second laminate. The cooling slots can extend radially through the second laminate. The cooling slots can be proximate to and can generally follow the outer peripheral surface of the second laminate. The cooling slots in the forward portion of the first laminate can be overlappingly offset from the cooling slots in the forward portion of the second laminate. As a result, a cooling slot in the forward portion of the first laminate can be in fluid communication with at least one slot in the forward portion of the second laminate. Such an arrangement can create a tortuous coolant path in the forward portion of the vane such that a coolant must move in the planar and radial directions through the forward portion of the vane.

Again, the laminates are made of a CMC material that can include a ceramic matrix and a plurality of fibers therein. In one embodiment, the fibers can be substantially oriented in two planar directions. A first portion of the fibers can extend in a first planar direction, and a second portion of the fibers can extend in a second planar direction. The first and second planar directions can be oriented at about 90 degrees relative to each other. At least one of the cooling slots can have ends that are filleted so as to substantially correspond to the orientation of the fibers.

DETAILED DESCRIPTION OF EMBODIMENTS OF THE INVENTION

Various cooling systems according to embodiments of the invention will be explained herein in the context of one possible stacked laminate turbine vane construction, but the detailed description is intended only as exemplary. Embodiments of the invention are shown in FIGS. 1-28, but the present invention is not limited to the illustrated structure or application.

Figure 1:
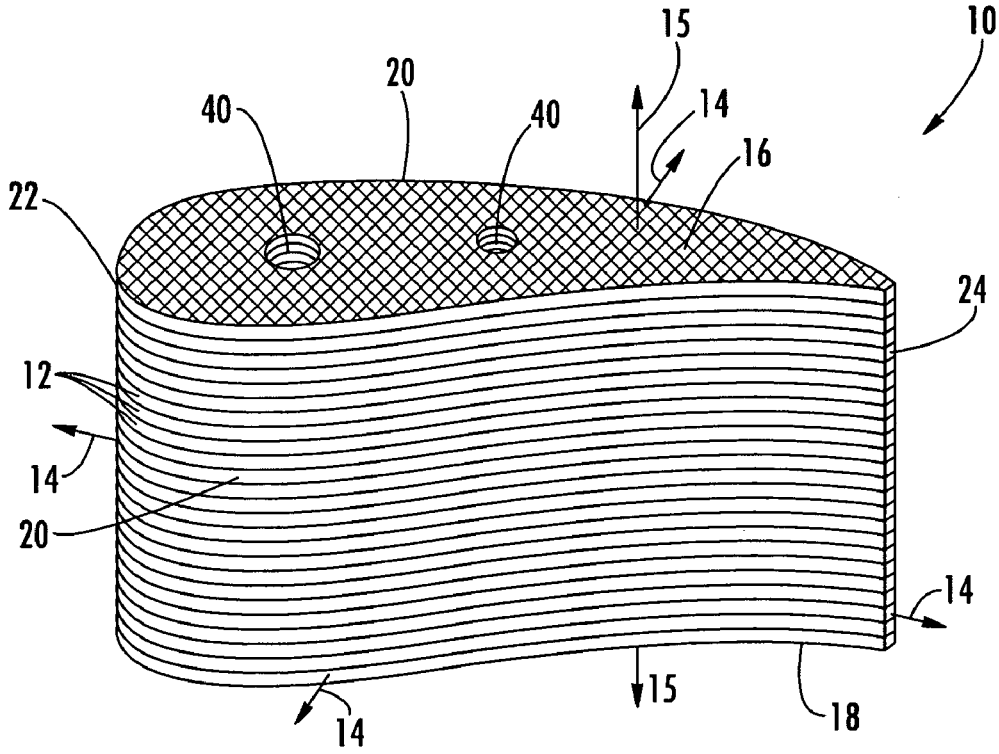
FIG. 1 is an isometric view of a turbine vane formed by a stack of airfoil-shaped CMC laminates according to aspects of the invention.

FIG. 1 shows one possible construction of a turbine vane assembly 10 according to aspects of the invention. The vane 10 can be made of a plurality of CMC laminates 12. The vane 10 can have a radially outer end 16 and a radially inner end 18 and an outer peripheral surface 20. The term "radial," as used herein, is intended to describe the direction of the vane 10 in its operational position relative to the turbine. Further, the vane assembly 10 can have a leading edge 22 and a trailing edge 24.

The individual laminates 12 of the vane assembly 10 can be substantially identical to each other; however, one or more laminates 12 can be different from the other laminates 12 in the vane assembly 10. Each laminate 12 can be airfoil-shaped. The term airfoil-shaped is intended to refer to the general shape of an airfoil cross-section and embodiments of the invention are not limited to any specific airfoil shape. Design parameters and engineering considerations can dictate the needed cross-sectional shape for a given laminate 12.

Figure 2:
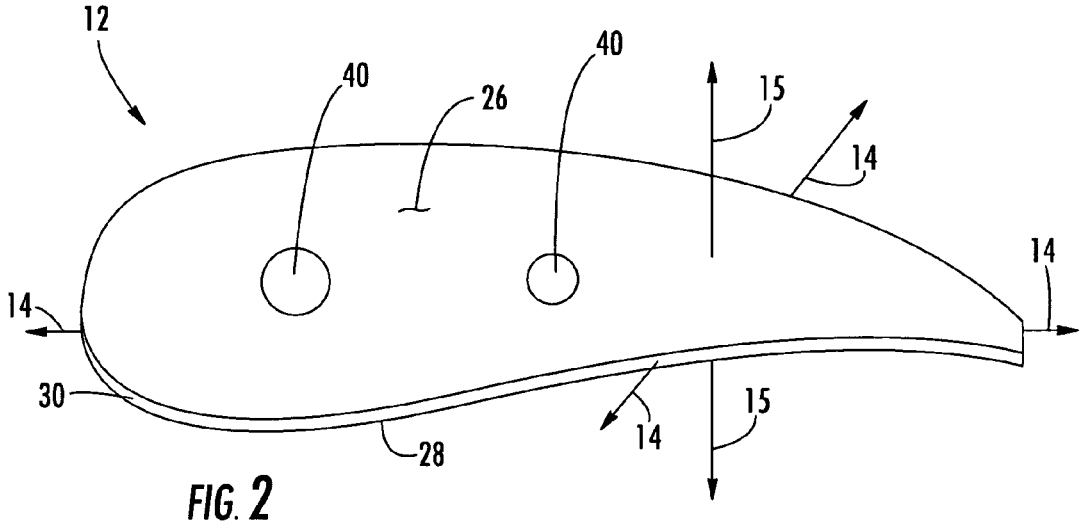
FIG. 2 is an isometric view of a single CMC laminate according to aspects of the invention.

Each laminate 12 can be substantially flat. Each laminate 12 can have a top surface 26 and a bottom surface 28 as well as an outer peripheral edge 30, as shown in FIG. 2. To facilitate discussion, each laminate 12 has an in-plane direction 14 and a through thickness direction 15. The through thickness direction 15 can be substantially normal to the in-plane direction 14. The through thickness direction 15 extends through the thickness of the laminate 12 between the top surface 26 to the bottom surface 28 of the laminate 12, preferably substantially parallel to the outer peripheral edge 30 of the laminate 12. In contrast, the in-plane direction 14 generally refers to any of a number of directions extending through the edgewise thickness of the laminate 12; that is, from one portion of the outer peripheral edge 30 to another portion of the outer peripheral edge 30. Preferably, the in-plane direction is substantially parallel to at least one of the top surface 26 and bottom surface 28 of the laminate 12.

Figure 4:
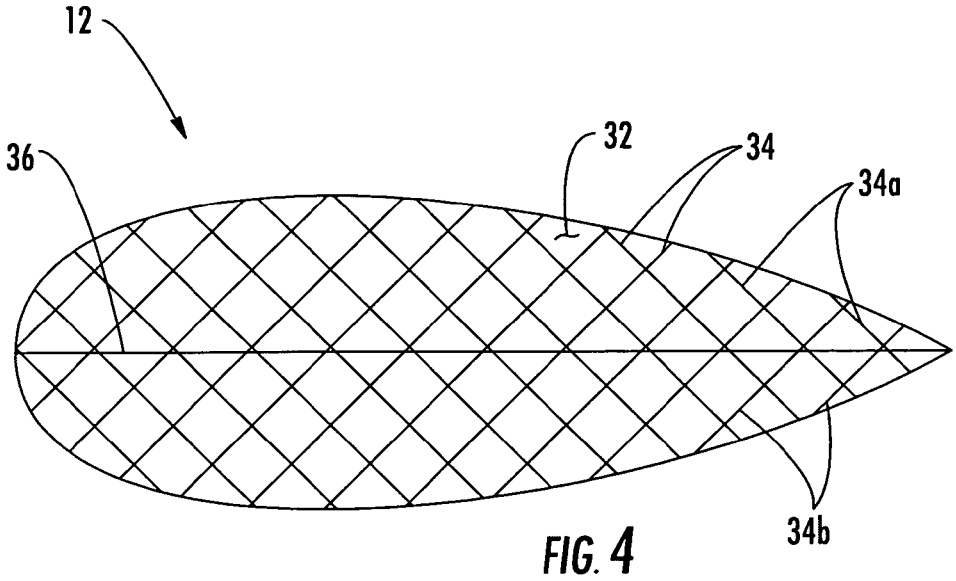
FIG. 4 is a top plan view of a CMC laminate according to aspects of the invention, showing a bi-directional network of fibers throughout the laminate, oriented in the in-plane directions.
Figure 5:
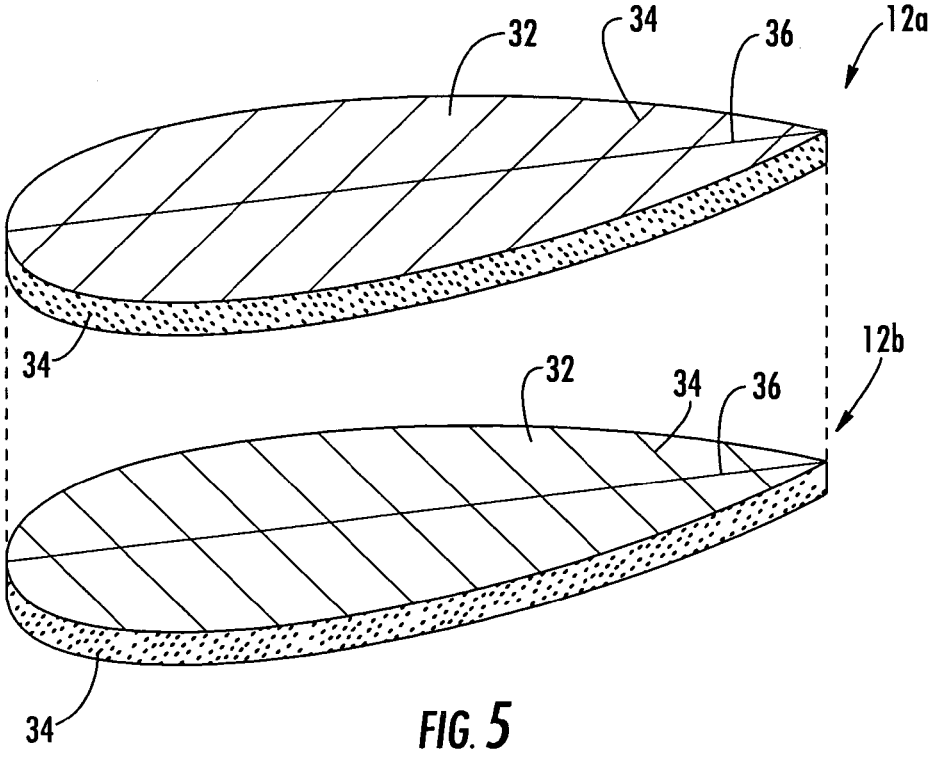
FIG. 5 is an exploded isometric view of two adjacent laminates in a turbine vane according to embodiments of the invention, showing one laminate having the fibers oriented in a first planar direction and another laminate having fibers oriented in a second planar direction that is substantially 90 degrees relative to the first planar direction.

As will be described in greater detail below, the laminates 12 can be made of a ceramic matrix composite (CMC) material. A CMC material comprises a ceramic matrix 32 that hosts a plurality of reinforcing fibers 34, as shown in FIG. 4. The CMC material can be anisotropic at least in the sense that it can have different strength characteristics in different directions. Various factors, including material selection and fiber orientation, can affect the strength characteristics of a CMC material.

A CMC laminate 12 having anisotropic strength characteristics according to embodiments of the invention can be made of a variety of materials, and embodiments of the invention are not limited to any specific materials so long as the target anisotropic properties are obtained. In one embodiment, the CMC can be from the oxide-oxide family. In one embodiment, the ceramic matrix 32 can be, for example, alumina. The fibers 34 can be any of a number of oxide fibers. In one embodiment, the fibers 34 can be made of Nextel™ 720, which is sold by 3M, or any similar material. The fibers 34 can be provided in various forms, such as a woven fabric, blankets, unidirectional tapes, and mats. A variety of techniques are known in the art for making a CMC material, and such techniques can be used in forming a CMC material having strength directionalities in accordance with embodiments of the invention.

As mentioned earlier, fiber material is not the sole determinant of the strength properties of a CMC laminate. Fiber direction can also affect the strength. In a CMC laminate 12 according to embodiments of the invention, the fibers 34 can be arranged to provide the vane assembly 10 with the desired anisotropic strength properties. More specifically, the fibers 34 can be oriented in the laminate 12 to provide strength or strain tolerance in the direction of high thermal stresses or strains. To that end, substantially all of the fibers 34 can be provided in the in-plane direction 14 of the laminate 12; however, a CMC material according to embodiments of the invention can have some fibers 34 in the through thickness direction as well. "Substantially all" is intended to mean all of the fibers 34 or a sufficient majority of the fibers 34 so that the desired strength properties are obtained. Preferably, the fibers 34 are substantially parallel with at least one of the top surface 26 and the bottom surface 28 of the laminate 12.

When discussing fiber orientation, a point of reference is needed. For purposes of discussion herein, the chord line 36 of the laminate 12 will be used as the point of reference; however, other reference points can be used as will be appreciated by one skilled in the art and aspects of the invention are not limited to a particular point of reference. The chord line 36 can be defined as a straight line extending from the leading edge 22 to the trailing edge 24 of the airfoil shaped laminate 12. In the planar direction 14, the fibers 34 of the CMC laminate 12 can be substantially unidirectional, substantially bi-directional or multi-directional.

Figure 12:
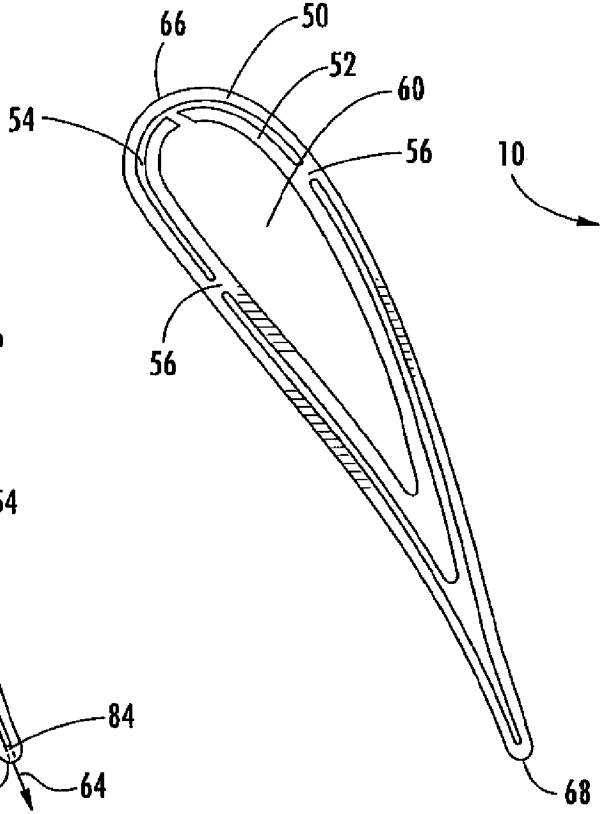
FIG. 12 is a top plan view of a laminate according to embodiments of the invention, showing a central plenum that is not in fluid communication with any cooling passages.
Figure 11:
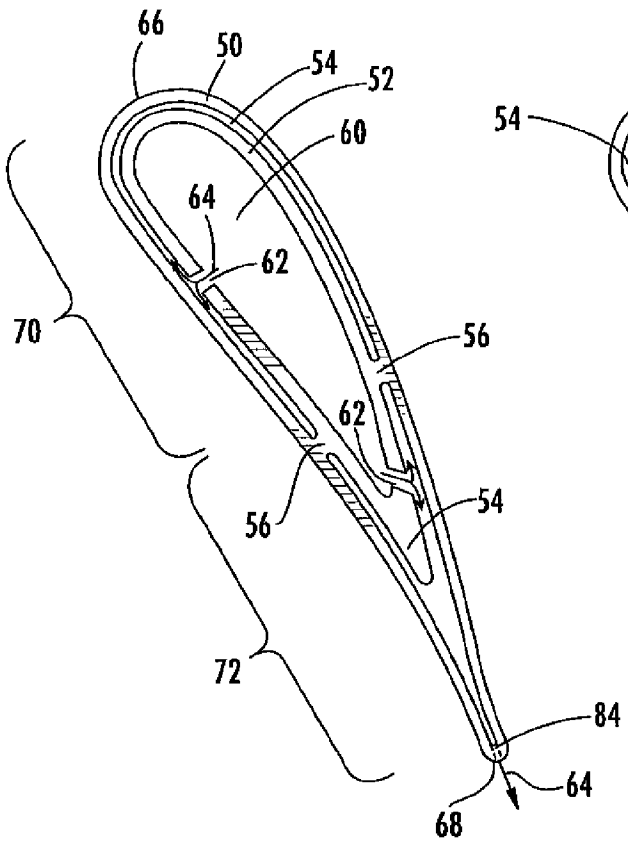
FIG. 11 is a top plan view of a laminate according to embodiments of the invention, showing the central plenum in fluid connection with a cooling passage near the trailing edge region of the laminate.

In a bi-directional laminate, like the laminate 12 shown in FIGS. 11-12, one portion of the fibers 34 can extend at one angle relative to the chord line 36 and another portion of the fibers 34 can extend at a different angle relative to the chord line 36 such that the fibers 34 cross. A preferred bi-directional fiber network includes fibers 34 that are oriented at about 90 degrees relative to each other, but other relative orientations are possible, such as at about 30 or about 60 degrees. In one embodiment, a first portion of the fibers 34*a* can be oriented at about 45 degrees relative to the chord line 36 of the laminate 12, while a second portion of the fibers 34*b* can be oriented at about −45 degrees (135 degrees) relative to the chord line 36, as shown in FIG. 4. Other possible relative fiber arrangements include: fibers 34 at about 30 and about 120 degrees, fibers 34 at 60 and 150 degrees, and fibers 34 at about 0 degrees and about 90 degrees relative to the chord line. These orientations are given in the way of an example, and embodiments of the invention are not limited to any specific fiber orientation. Indeed, the fiber orientation can be optimized for each application depending at least in part on the cooling system, temperature distributions and the expected stress field for a given vane.

As noted earlier, the fibers 34 can be substantially unidirectional, that is, all of the fibers 34 or a substantial majority of the fibers 34 can be oriented in a single direction. For example, the fibers 34 in one laminate can all be substantially aligned at, for example, 45 degrees relative to the chord line 36, such as shown in the laminate 12*a* in FIG. 5. However, in such case, it is preferred if at least one of the adjacent laminates is also substantially unidirectional with fibers 34 oriented at about 90 degrees in the opposite direction. For example, the laminate 12*b* in FIG. 5 includes fibers 34 oriented at about −45 degrees (135 degrees) relative to the chord line 36. In the context of a vane assembly 10, such alternation can repeat throughout the vane assembly or can be provided in local areas.

Aside from the particular materials and the fiber orientations, the CMC laminates 12 according to embodiments of the invention can be defined by their anisotropic properties. For example, the laminates 12 can have a tensile strength in the in-plane direction 14 that is substantially greater than the tensile strength in the through thickness direction 15. In one embodiment, the in-plane tensile strength can be at least three times greater than the through thickness tensile strength. In another embodiment, the ratio of the in-plane tensile strength to the through thickness tensile strength of the CMC laminate can be about 10 to 1. In yet another embodiment, the in-plane tensile strength can be from about 25 to about 30 times greater than the through thickness tensile strength. Such unequal directionality of strengths in the laminates 12 is desirable for reasons that will be explained later.

One particular CMC laminate 12 according to embodiments of the invention can have an in-plane tensile strength from about 150 megapascals (MPa) to about 200 MPa in the fiber direction and, more specifically, from about 160 MPa to about 184 MPa in the fiber direction. Further, such a laminate 12 can have an in-plane compressive strength from about 140 MPa to 160 MPa in the fiber direction and, more specifically, from about 147 MPa to about 152 MPa in the fiber direction.

This particular CMC laminate 12 can be relatively weak in tension in the through thickness direction. For example, the through thickness tensile strength can be from about 3 MPa to about 10 MPa and, more particularly, from about 5 MPa to about 6 MPa, which is substantially lower than the in-plane tensile strengths discussed above. However, the laminate 12 can be relatively strong in compression in the through thickness direction. For example, the through thickness compressive strength of a laminate 12 according to embodiments of the invention can be from about −251 MPa to about −314 MPa.

The above strengths can be affected by temperature. Again, the above quantities are provided merely as examples, and embodiments of the invention are not limited to any specific strengths in the in-plane or through thickness directions.

As noted earlier, a vane assembly 10 according to embodiments of the invention can be formed by a stack of CMC laminates 12. Up to this point, the terms "in-plane" and "through thickness" have been used herein to facilitate discussion of the anisotropic strength characteristics of a CMC laminate in accordance with embodiments of the invention. While convenient for describing an individual laminate 12, such terms may become awkward when used to describe strength directionalities of a turbine vane 10 formed by a plurality of stacked laminates according to embodiments of the invention. For instance, the "in-plane direction" associated with an individual laminate generally corresponds to the axial and circumferential directions of the vane assembly 10 in its operational position relative to the turbine. Similarly, the "through thickness direction" generally corresponds to the radial direction of the vane assembly 10 relative to the turbine. Therefore, in connection with a turbine vane 10, the terms "radial" or "radial direction" will be used in place of the terms "through thickness" or "through thickness direction." Likewise, the terms "planar" or "planar direction" will be used in place of the terms "in-plane" and "in-plane direction."

With this understanding, the plurality of laminates 12 can be substantially radially stacked to form the vane assembly 10 according to embodiments of the invention. The outer peripheral edges 30 of the stacked laminates 12 can form the exterior surface 20 of the vane assembly 10. As noted earlier, the individual laminates 12 of the vane assembly 10 can be substantially identical to each other. Alternatively, one or more laminates 12 can be different from the other laminates 12 in a variety of ways including, for example, thickness, size, and/or shape.

Figure 3:
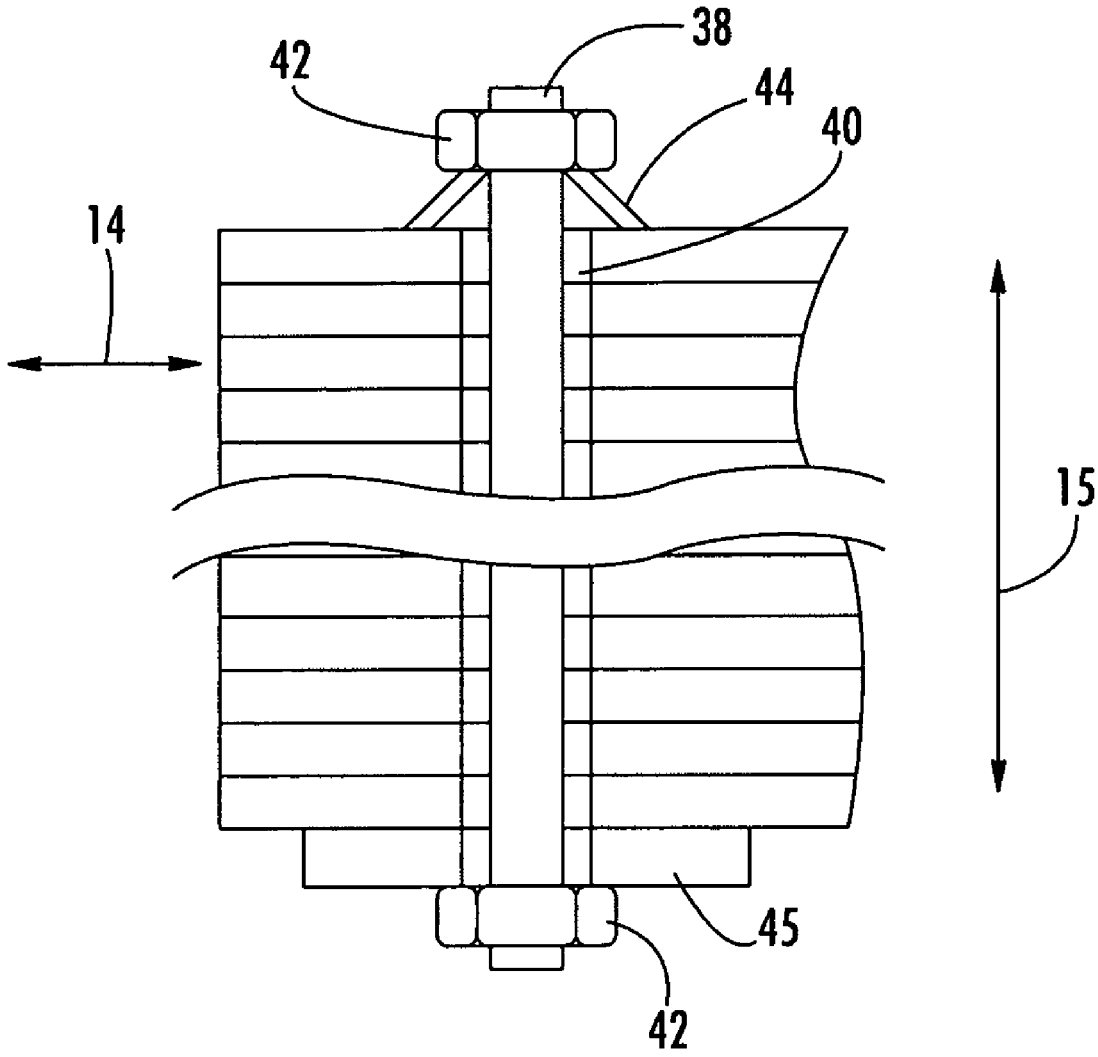
FIG. 3 is a partial cross-sectional view of a stacked CMC laminate turbine vane according to aspects of the invention, showing a system for radially pre-compressing the laminates in accordance with embodiments of the invention.

The plurality of laminates 12 can be held together in numerous manners. For instance, the stack of laminates 12 can be held together by one or more fasteners including tie rods 38 or bolts, as shown in FIG. 3. In one embodiment, there can be a single fastener. In other embodiments there can be at least two fasteners. To accommodate the fasteners, one or more openings 40 can be provided in each laminate 12 so as to form a substantially radial opening through the vane assembly 10.

The fastener can be closed by one or more retainers to hold the laminate stack together in radial compression. The retainer can be a nut 42 or a cap, just to name a few possibilities. The fastener and retainer can be any fastener structure that can carry the expected radial tensile loads and gas path bending loads, while engaging the vane assembly 10 to provide a nominal compressive load on the CMC laminates 12 for all service loads so as to avoid any appreciable buildup of interlaminar tensile stresses in the radial direction 15, which is the weakest direction of a CMC laminate 12 according to aspects of the invention. The fastener and retainer can further cooperate with a compliant fastener, such as a Bellville washer 44 or conical washer, to maintain the compressive pre-load, while permitting thermal expansion without causing significant thermal stress from developing in the radial direction 15. To more evenly distribute the compressive load on the laminates 12, the fastener and/or retainer can cooperate with a load spreading member 45, such as a washer. The load spreading member 45 can be used with or without a Bellville washer 44 or other compliant fastener.

In addition or apart from using fasteners, at least some of the individual laminates 12 can also be bonded to each other. Such bonding can be accomplished by sintering the laminates or by the application of a bonding material between each laminate. For example, the laminates 12 can be stacked and pressed together when heated for sintering, causing adjacent laminates 12 to sinter together. Alternatively, a ceramic powder can be mixed with a liquid to form a slurry. The slurry can be applied between the laminates 12 in the stack. When exposed to high temperatures, the slurry itself can become a ceramic, thereby bonding the laminates 12 together.

In addition to sintering and bonding, the laminates 12 can be joined together through co-processing of partially processed individual laminates using such methods as chemical vapor infiltration (CVI), slurry or sol-gel impregnation, polymer precursor infiltration & pyrolysis (PIP), melt-infiltration, etc. In these cases, partially densified individual laminates are formed, stacked, and then fully densified and/or fired as an assembly, thus forming a continuous matrix material phase in and between the laminates.

It should be noted that use of the phrase "at least one of co-processing, sintering and bonding material," as used herein, is intended to mean that only one of these methods may be used to join individual laminates together, or that more than one of these methods can be used to join individual laminates together. Providing an additional bond between the laminates (whether by co-processing, sintering or having bonding material between each laminate 12) is particularly ideal for highly pressurized cooled vanes where the cooling passages require a strong seal between laminates 12 to contain pressurized coolant, such as air, flowing through the interior of the vane assembly 10.

The airfoil-shaped CMC laminates 12 according to embodiments of the invention can be made in a variety of ways. Preferably, the CMC material is initially provided in the form of a substantially flat plate. From the flat plate, one or more airfoil shaped laminates can be cut out, such as by water jet or laser cutting.

The operation of a turbine is well known in the art as is the operation of a turbine vane. During operation, a turbine vane can experience high stresses in three directions—in the radial direction 15 and in the planar direction 14 (which encompasses the axial and circumferential directions of a vane relative to the turbine). A vane according to aspects of the invention is well suited to manage such a stress field.

In the planar direction 14, high stresses can arise because of thermal gradients between the hot exterior vane surface and the cooled vane interior. The thermal expansion of the vane exterior and the thermal contraction of the vane interior places the vane in tension in the planar direction 14. However, a vane assembly 10 according to embodiments of the invention is well suited for such loads because, as noted above, the fibers 34 in the CMC are aligned in the planar direction 14, giving the vane 10 sufficient planar strength or strain tolerance. Such fiber alignment can also provide strength against pressure stresses that can occur in the turbine.

In the radial direction 15, thermal gradients and aerodynamic bending forces can subject the vane 10 to high radial tensile stresses. While relatively weak in radial tension, a vane 10 according to embodiments of the invention can take advantage of the though thickness compressive strength of the laminates 12 (that is, the radial compressive strength of the vane 10) to counter the radial forces acting on the vane 10. To that end, the vane 10 can be held in radial compression at all times by tie bolts 38 or other fastening system. As a result, radial tensile stresses on the vane 10 are minimized.

During operation, the vane assembly 10 can be exposed to high temperatures, so the vane assembly 10 may require cooling. A stacked laminate vane construction as discussed above can permit the inclusion of cooling systems that would not otherwise be possible or practical in a conventional CMC vane design.

Figure 6:
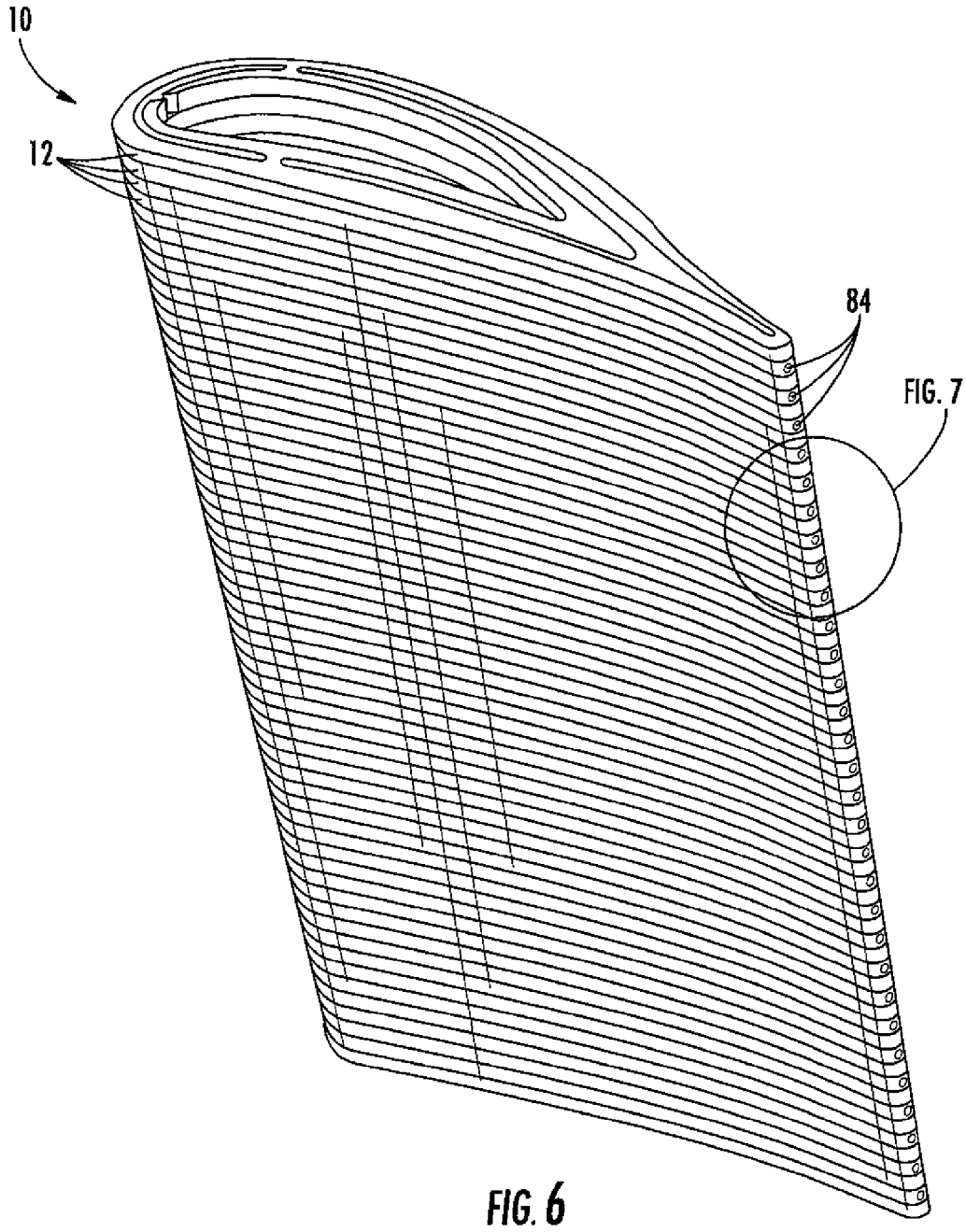
FIG. 6 is an isometric view of a turbine vane formed by a stack of airfoil-shaped CMC laminates with a cooling system according to aspects of the invention.
Figure 7:
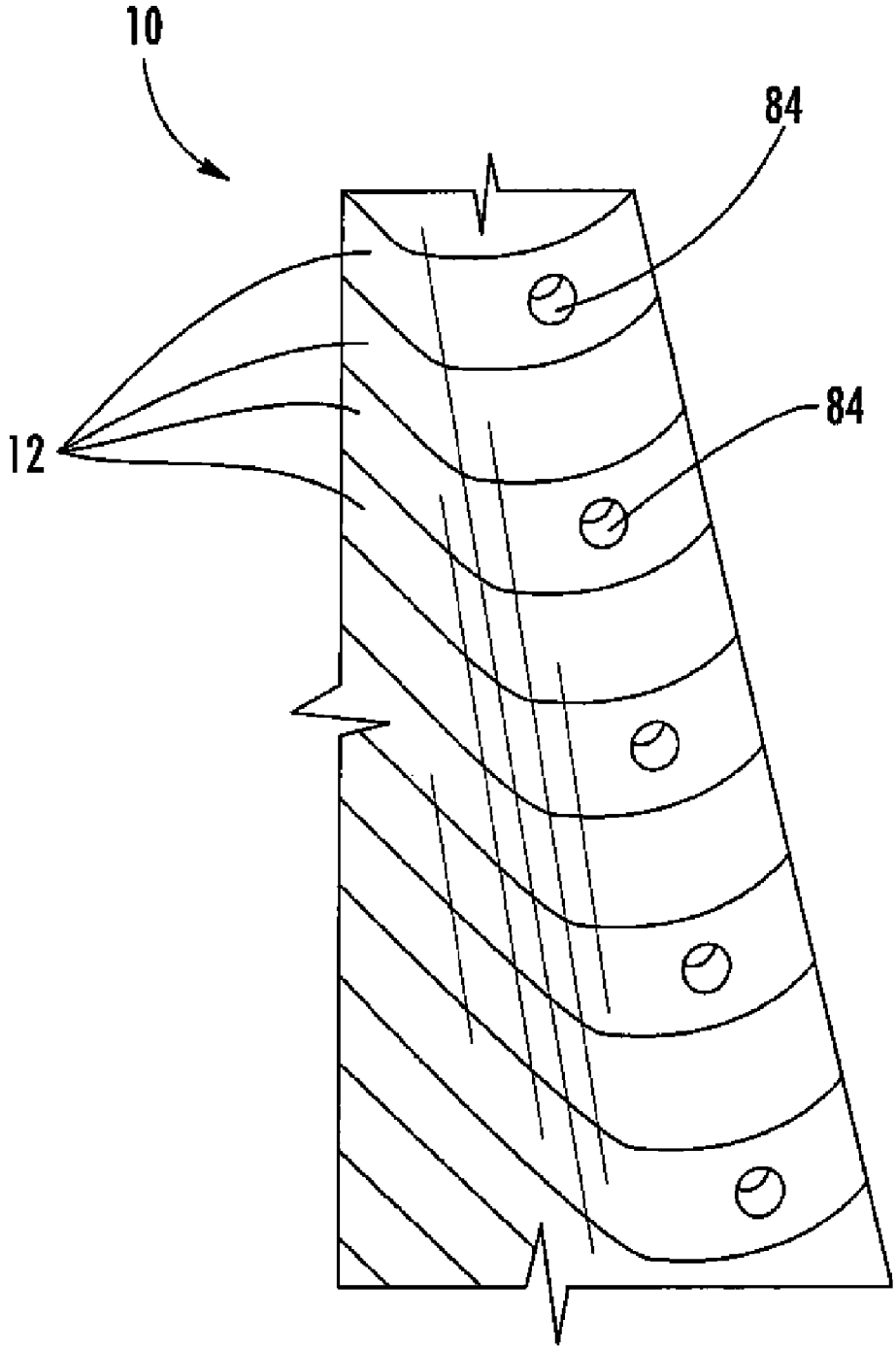
FIG. 7 is an isometric view of a portion of the trailing edge of a stacked laminate CMC turbine vane according to embodiments of the invention, showing a plurality of trailing edge exit holes.
Figure 8:
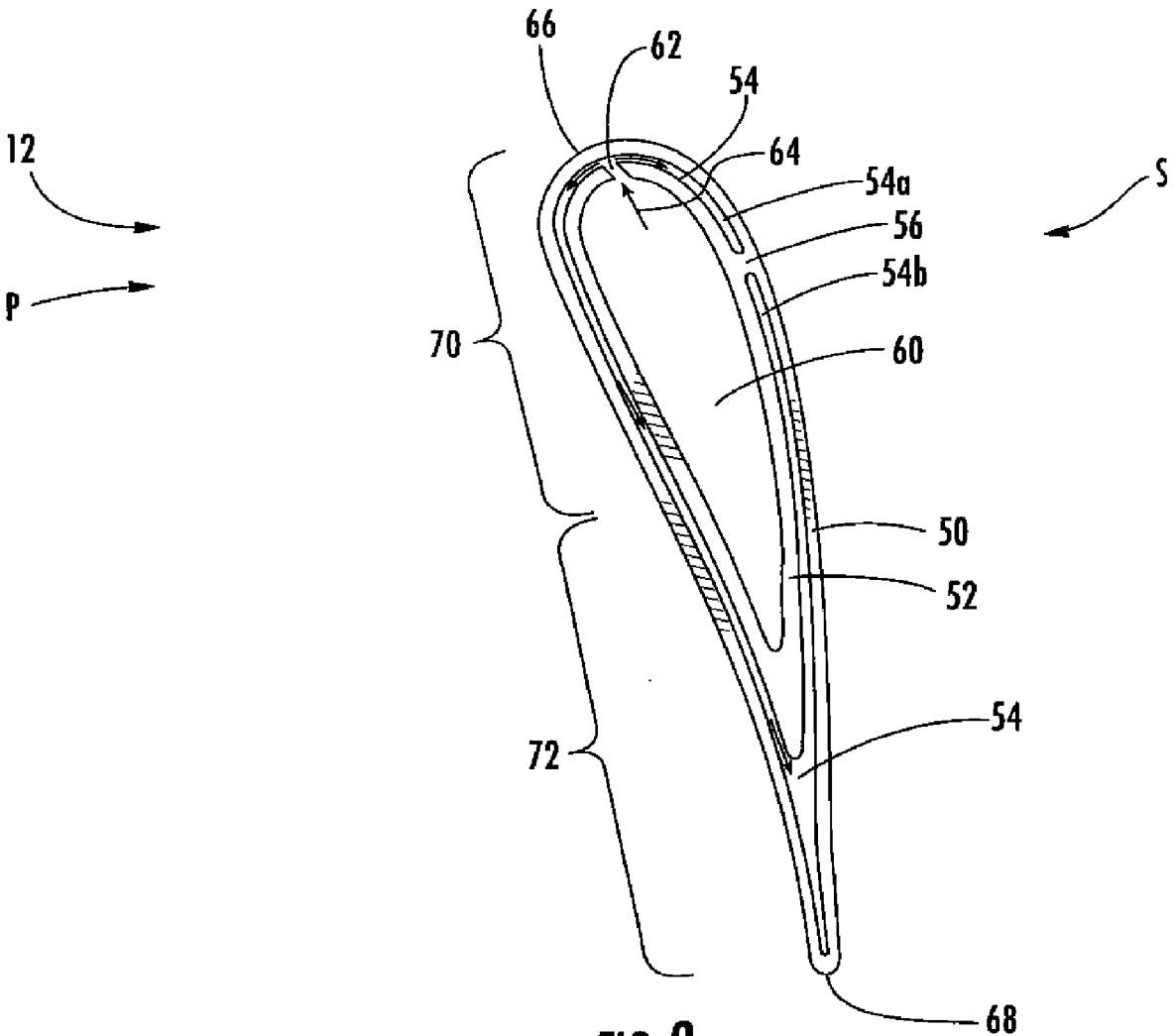
FIG. 8 is a top plan view of a CMC laminate, showing one cooling system according to embodiments of the invention.

Embodiments of one cooling system according to aspects of the invention are shown in FIGS. 6-13. Referring to FIG. 8, one or more laminates 12 in the radial stack can include an outer airfoil-shaped wall 50 enclosing an inner wall 52. The inner wall 52 can be airfoil-shaped. Further, the shape of the inner wall 52 can be substantially geometrically similar to the shape of the outer wall 50, but it can also be different. The thickness of the outer wall 50 may or may not be substantially equal to the thickness of the inner wall 52. In one embodiment, the outer and inner walls 50, 52 can be about 3 millimeters thick. The thicknesses of the outer and inner walls 50, 52 can optimized based on a number of factors including cooling effectiveness, mechanical support, rigidity and thermal compliance between the hot outer wall 50 and the cool inner wall 52 during engine operation.

The inner wall 52 can be spaced from the outer wall 50 so as to define a cooling passage 54 therebetween. The outer and inner walls 50, 52 can be connected by one or more ribs 56 that can extend in the in-plane direction 14 of the laminate 12. The ribs 56 can be provided at various locations between the outer and inner walls 50, 52. Embodiments of the invention are not limited to any particular quantity, shape or thickness of the ribs 56. In the case of two or more ribs 56, the ribs 56 can be substantially identical in size and shape, or they can be different in at least one of these respects.

Figure 13:
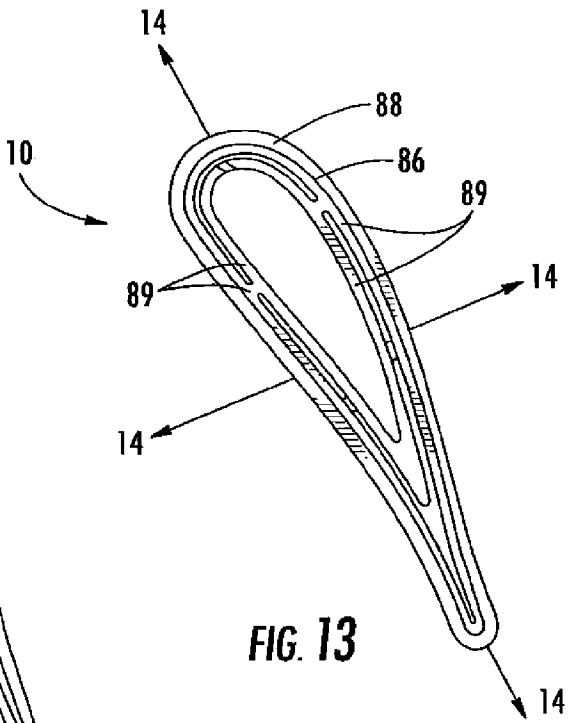
FIG. 13 is a top plan view of a stacked laminate vane having a cooling system according to embodiments of the invention, showing a thermal insulation material covering the outer peripheral surface of the vane.

The ribs 56 can provide structural support to accommodate, among other things, the non-relenting mechanical loads on the vane assembly 10. For instance, the ribs 56 can support the outer wall 50 against the pressure load of the combustion gases in the turbine. The ribs 56 can also provide compliance for thermal loads. In operation, the vane assembly 10 and each laminate 12 can have a pressure side P and a suction side S. The pressure side P generally faces the oncoming combustion gases whereas the suction side S generally faces away from the oncoming combustion gases. In some instances, there may not be any ribs 56 on the pressure side P of the laminate 12, as shown in FIG. 13, due to the high thermal stresses on that side.

For each laminate 12 in a vane assembly 10 configured with a cooling system according to aspects of the invention, the location, shape, thickness and quantity of ribs 56 can be identical, or they can be different in one or more of these and other respects. Similarly, the design of the laminates 12 and arrangement of the laminates in the stack can vary in each vane assembly 10 in the turbine.

In addition to structural support, the ribs 56 can divide the cooling passage 54 into a set of discrete cooling passages 54*a*, 54*b*. The ribs 56 can allow the cooling channels 54 to be positioned closer to the hot outer peripheral surface 58 for cooling effectiveness while retaining structural rigidity and robustness of a thick-walled structure. As shown in FIG. 8, the laminate does not provide a central core; in other words, the inner wall 52 can define a plenum 60 in the vane assembly 10. In one embodiment, the plenum 60 can be substantially airfoil-shaped in conformation, but other conformations are possible.

Such a core-less arrangement can avoid potentially detrimental thermal growth issues that may otherwise occur. More particularly, if the outer wall 50 enclosed a central airfoil-shaped solid mass (not shown) as opposed to the relatively thin inner wall 52 according to aspects of the invention, differences in thermal inputs on these portions of the laminate could possibly jeopardize the integrity of the laminate 12 and possibly the vane assembly 10 itself. For example, the outer wall 50 experiences larger heat inputs than the central mass because the outer wall 50 is in contact with the hot combustion gases. If the outer wall 50 attempts to expand outward, the cooler solid central mass would resist such outward growth, potentially causing breakage of the connecting ribs 56 and separation of the solid inner mass. Thus, the inner wall 52 of an airfoil laminate 12 according to embodiments of the invention can be sized to account for the unequal thermal expansion and contraction between the hot outer wall 50 and the relatively cool inner wall 52.

The plenum 60 can be in fluid communication with at least some of the cooling passages 54 by one or more supply openings 62 extending through the inner wall 52. Thus, a coolant 64 supplied to the plenum 60 can flow through the supply opening 62 and into the cooling passages 54. The supply opening 62 can be provided in various locations about the laminate 12. For instance, the supply opening 62 can be proximate the leading edge 66. Alternatively, the supply openings 62 can be provided closer to the trailing edge 68, as shown in FIG. 11. The supply opening 62 can be located anywhere along the inner wall 52, and embodiments of the invention are not limited to any particular location.

A laminate 12 according to embodiments of the invention can include any quantity of supply openings 62. In the case of two or more supply openings 62, the supply openings 62 can be substantially identical to each other, or they can be different. Embodiments of the invention are not limited to any particular configuration, size or shape for the supply openings 62. In some laminates, there may not be any supply openings 62, as shown in FIG. 12. As a result, the plenum 60 and the cooling passages 54 would not be in fluid communication. Between adjacent laminates 12 in a vane assembly 10, the supply openings 62 in one laminate 12 can be substantially aligned with the supply openings 62 in an adjacent laminate 12, or they can be offset from each other (see, for example, FIG. 9).

In general, each laminate 12 has a forward region 70 that includes the leading edge 66 and an aft region 72 that includes the trailing edge 72. The location of a supply opening 62 can affect the effectiveness of the coolant 64 in the cooling passages 54. For example, in the case of the laminate 12 shown in FIG. 8, the only supply passage 62 provided by the laminate 12 is in the forward region 70 near the leading edge 66. As a coolant 64 exits the supply passage 62, the coolant 64 must first travel through the cooling passages 54 along the leading edge 66 and the forward region 70 of the laminate 12 before entering those portions of the cooling passage 54 in the aft region 72 of the laminate 12. Thus, when the coolant 64 reaches the trailing edge 68, it has already been heated during its flow through the cooling passage 54 in the forward region 70, reducing the cooling effectiveness of the coolant 64 in the aft region 72, particularly near the trailing edge 68. If a lower cooling temperature is desired for the trailing edge 68, a supply opening 62 can be provided near the trailing edge 68 of the laminate 12, as shown in FIG. 11. In such case, the coolant 64 can be directly injected into the cooling passage 54 near the trailing edge 68 of the laminate 12, thereby increasing the cooling effectiveness of the coolant 64 in the trailing edge 68. If provided in combination with supply openings 62 in the forward portion 70 of the laminate 12, the supply openings 62 in the aft region 72 can counter the heating of the coolant 64 that has first traveled through the forward region 70. Thus, in at least these ways, it will be appreciated that the location of the supply passages 62 can affect the cooling of certain portions of the laminate 12.

The laminates 12 according to embodiments of the invention and any of the above described features therein—ribs, plenum, supply openings, and cooling passages—can be made using various machining techniques including, for example, laser cutting and water jet cutting.

Figure 9:
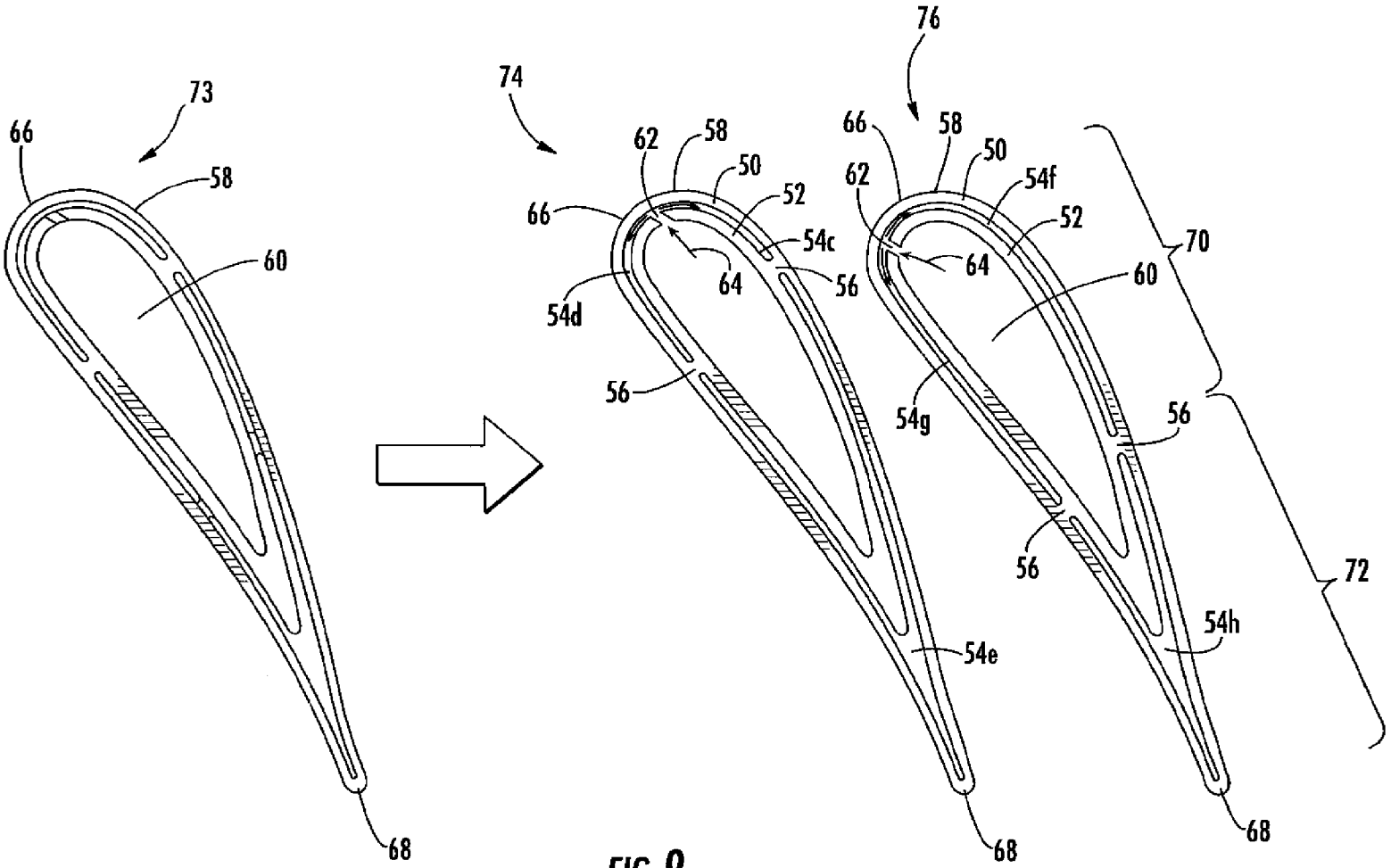
FIG. 9 is a top exploded view of one possible pair of adjacent laminates in a laminate stack according to embodiments of the invention.

In one embodiment, shown in FIG. 9, one pair of laminates 73 can include at least a first laminate 74 and a second laminate 76. The first and second laminates 74, 76 can be adjacent to each other in the vane assembly 10. The first laminate 74 can have two ribs 56 so as to define three cooling passages 54*c*, 54*d*, 54*e* in the laminate 74. The ribs 56 can be positioned toward the forward portion 70 of the first laminate 74. The first laminate 74 can have a supply opening 62 near the leading edge 66. The second laminate 76 can have two ribs 56 so as to define three cooling passages 54*f*, 54*g*, 54*h* in the laminate 76. The ribs 56 can be positioned in or near the aft portion 72 of the laminate 76. The second laminate 76 can have a supply opening 62 near the leading edge 66. The supply openings 62 in the first and second laminates 74, 76 can be positioned such that, when the laminates 74, 76 are stacked together 73, the supply openings 62 are offset in a non-overlapping manner. Preferably, the three cooling passages 54*c*, 54*d*, 54*e* in the first laminate 74 offsettingly overlap the three cooling passages 54*f*, 54*g*, 54*h* in the second laminate 76.

The first and second laminates 74, 76 may be a unique pair of laminates in the vane assembly 10. Alternatively, the first and second laminates 74, 76 can be provided in various alternating arrangements in the vane assembly 10. It should be noted that the term "alternating" is intended to broadly mean any alternating arrangement of the first and second laminates 74, 76. Embodiments of the invention are not limited to any particular manner of alternating the first and second laminates 74, 76. For instance, using the letter A to designate the first laminate 74 and the letter B to designate the second laminate 76, the laminates 74, 76 can be stacked in various manners such as ABABAB, AABBAABB, and ABBABBABBA, just to name a few possibilities. The vane assembly 10 may include a third laminate, which can be, for example, a substantially solid laminate with no cooling features or passages other than a plenum. Labeling such a laminate as C, the laminates can be stacked, for example, according to the pattern ABCABCABC.

Figure 10:
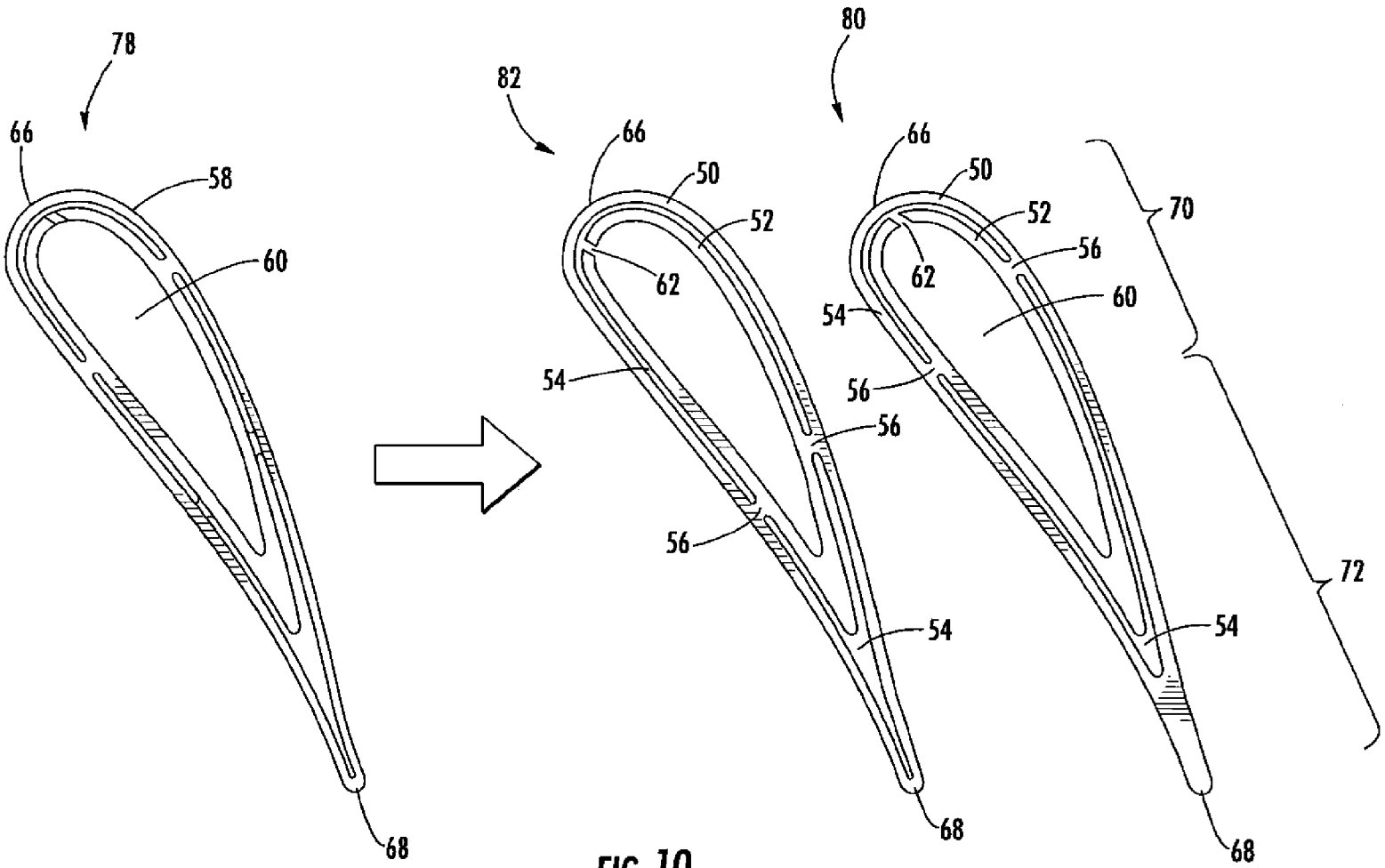
FIG. 10 is a top exploded view of another possible pair of adjacent laminates in a laminate stack according to embodiments of the invention.

Another pair of adjacent laminates 78 according to embodiments of the invention is shown in FIG. 10. The pair of laminates 78 can include a first laminate 80 and a second laminate 82. In the first laminate 80, the spacing between the outer and inner walls 50, 52 (that is, the width of the cooling passage 54) can be substantially constant about the entire periphery of the laminate 80. For instance, the spacing between the outer and inner walls 50, 52 can be maintained from about 2 millimeters to about 3 millimeters. In such case, a substantial portion of the trailing edge 68 of the laminate 80 can be relatively solid. In the second laminate 82, the spacing between the outer and inner walls 50, 52 can be substantially constant in the forward portion 70 of the laminate 82. But, in the aft portion 72 of the laminate 82, particularly near the trailing edge 68, the spacing can increase at least in some areas so as to form a relatively hollow trailing edge 68. Extra cooling can be provided to the aft portion 72 of the laminate 82, such as by providing supply openings 62 between the plenum 60 and the cooling passages 54 near the trailing edge 68 (see FIG. 11).

A coolant 64 in the cooling passages 54 can be expelled from the vane assembly 10 in various ways. Referring to FIGS. 6-8, one or more laminates 12 can include a discharge opening 84 extending from one of the cooling passages 54 and through the outer wall 50 of the laminate 12. The discharge opening 84 can extend in the planar direction 14 of the laminate 12. In one embodiment, the discharge opening 84 can extend through the trailing edge 68 of the laminate (see also FIG. 11). Thus, a coolant 66 in the cooling passage 54 can exit the vane assembly 10 at the trailing edge 68 so as to minimize aerodynamic disruptions in the turbine gas path. Such openings 84 may be formed during the process of cutting of the individual laminates 12 using, for example, a laser. Alternatively, the openings 84 can be added at a later stage in the manufacture of the CMC vane 10 according to embodiments of the invention, such as by drilling after assembling the laminates 12 in a radial stack.

The discharge openings 84 can have any of a number of shapes, but substantially circular discharge openings 84 are preferred. A plurality of discharge openings 84 can be provided in the vane assembly 10. The discharge openings 84 can be provided at a regular interval. For example, the discharge openings 84 can be provided in every other laminate 12, as shown in FIGS. 6-8. However, the discharge openings 84 can be provided at irregular intervals as well.

In some instances, at least a portion of the outer peripheral surface 86 of the vane assembly 10 according to embodiments of the invention may need additional thermal protection. To that end, one or more layers of a thermal insulating material or a thermal barrier coating 88 can be applied around the outer peripheral surface 86 of the vane 10, as shown in FIG. 13. In one embodiment, the thermal barrier coating 88 can be a friable graded insulation (FGI), which is known in the art, such as in U.S. Pat. Nos. 6,670,046 and 6,235,370, which are incorporated herein by reference. When a thermal insulating material or thermal barrier coating 88 substantially covers at least the outer peripheral surface 86 of the vane assembly 10, thermal gradients across the structural CMC portion 89 of the vane 10 in the planar direction 14 can be reduced.

Figure 14:
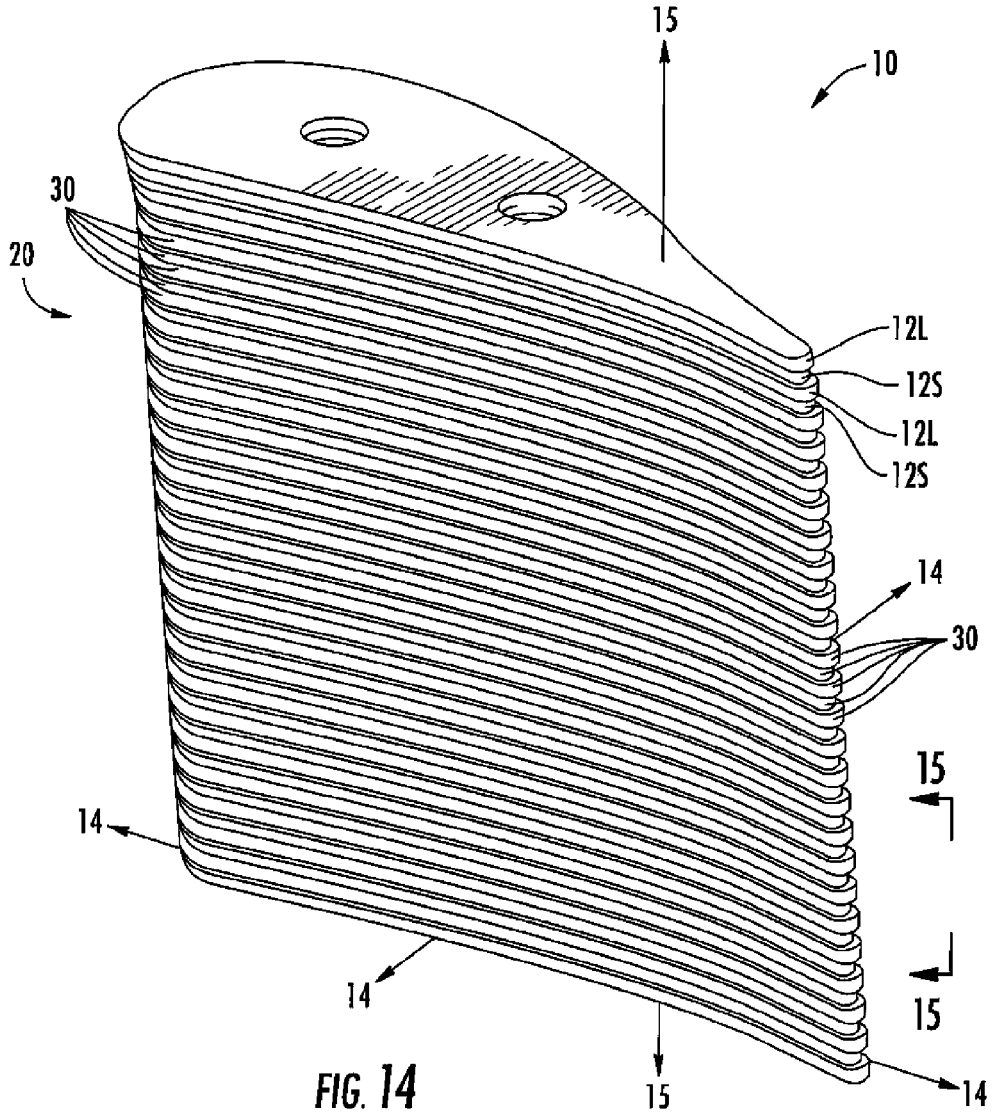
FIG. 14 is an isometric view of a CMC turbine vane having a stepped outer peripheral surface formed by alternating large and small laminates in accordance with aspects of the invention.

Embodiments of another cooling system according to aspects of the invention are shown in FIGS. 14-21. A turbine vane can be formed by a radial stack of CMC laminates having an airfoil-shaped outer periphery. The individual laminates can be different sizes so that the stacked vane has a stepped outer surface, as shown in FIG. 14.

For example, the vane 10 can be assembled so that large laminates 12L alternate with small laminates 12S to form the stepped outer surface. The large laminates 12L and the small laminates 12S can be substantially geometrically similar. The terms "large" and "small" are intended to refer to the relative size of the outer peripheral surface 30 of a laminate. The large laminates 12L can be slightly larger than the small laminates 12S, such that when stacked, the large laminates 12L can overhang the small laminates 12S from about 2 millimeters to about 3 millimeters. Such an overhang can span about the entire periphery 30 of the small laminate 12S. Preferably, the amount that a large laminate 12L overhangs a smaller laminate 12S is substantially constant about the periphery 30 of the small laminate 12S.

It should be noted that embodiments of the invention are not limited to laminates of just two sizes. The term "large laminates" can include laminates of various sizes so long as they are generally larger than the adjacent small laminates. Similarly, the term "small laminates" can include laminates of various sizes so long as they are generally smaller than the adjacent large laminates.

As noted above, the large laminates 12L can alternate with small laminates 12S. It should be noted that the term "alternate" is intended to broadly mean any alternating arrangement of the large laminates 12L and small laminates 12S. Embodiments of the invention are not limited to any particular manner of alternating the large laminates 12L and the small laminates 12S. For instance, using the letter A to designate the large laminates and the letter B to designate the smaller laminates, the laminates can be stacked in at least the following possible ways: ABABAB (see FIG. 15), AABBAABB, ABBABBABBA. In the case of additional laminates that are different in some respect from the large laminates 12L and the small laminates 12S, generally designated by the letter C, the laminates can be stacked, for example, according to the pattern ABCABCABC, as one example.

Figure 15:
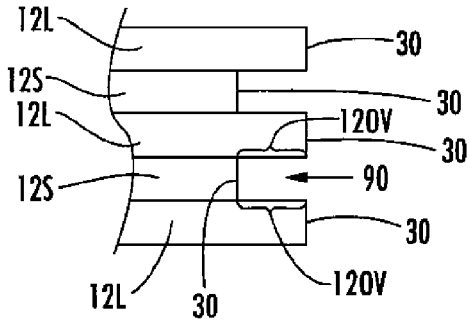
FIG. 15 is a side elevational view of a portion of the CMC turbine vane in FIG. 14, showing recesses formed in the outer peripheral surface of the vane according to embodiments of the invention.

Thus, it will be appreciated that the outer peripheral surface 20 of the vane 10 can be formed by the outer periphery 30 of each laminate 12L, 12S as well as the overhanging portions 12OV of the large laminates 12L or other externally exposed portion of the laminates 12L, 12S in the vane stack 10. Referring to FIG. 15, the overhanging portions 12OV of the large laminates 12L along with the outer periphery 30 of the small laminates 12S therebetween can define a series of recesses 90 extending about the outer peripheral surface 20 of the vane assembly 10. Specifically, each recess 90 can be defined by the outer periphery 30 of at least one small laminate 12S and the adjacent overhanging portions 120V of two large laminates 12L.

An outer covering can be applied over or in substantially surrounding relation to the outer peripheral surface 20 of the vane 10 so as to close the open end of the recesses 90, thereby forming a series of individual cooling channels 92 extending about the vane 10. There can be any number of cooling channels 92 extending about the vane 10. The cooling channels 92 can be radially spaced from each other. Preferably, the cooling channels 92 are substantially parallel to each other. The cooling channels 92 can be substantially identical to each other, or at least one can be different in any of a number of ways including size or cross-sectional geometry.

Ideally, the outer covering is applied after the laminates 12S, 12L are at least partially cured or sintered. In order to form such channels 92, a sacrificial filler material can be included in the recesses 90 in the outer peripheral surface 20 of the vane 10 so as to substantially prevent any outer covering material from entering the recess 90. The vane 10 can then be heated to facilitate bonding between the outer covering and the outer peripheral surface 20 of the vane 10 such that the sacrificial filler material is destroyed, leaving the cooling channel 92 behind. Alternately and preferably, the filler material can be completely removed prior to the final curing and bonding steps.

Figure 16:
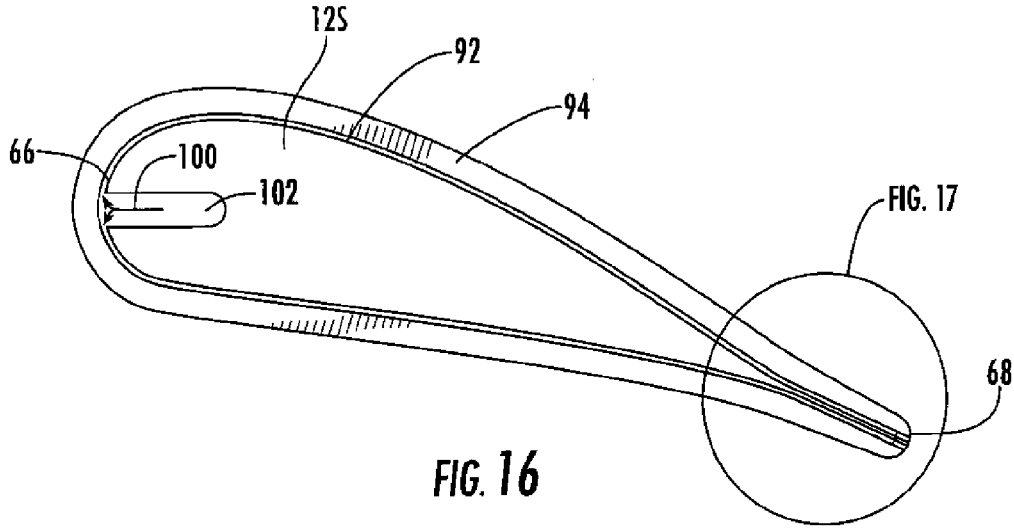
FIG. 16 is a cross-sectional top plan view of a stacked laminate vane according to embodiments of the invention, showing an outer covering cooperating with the stepped outer peripheral surface to form cooling channels about the vane.
Figure 17:
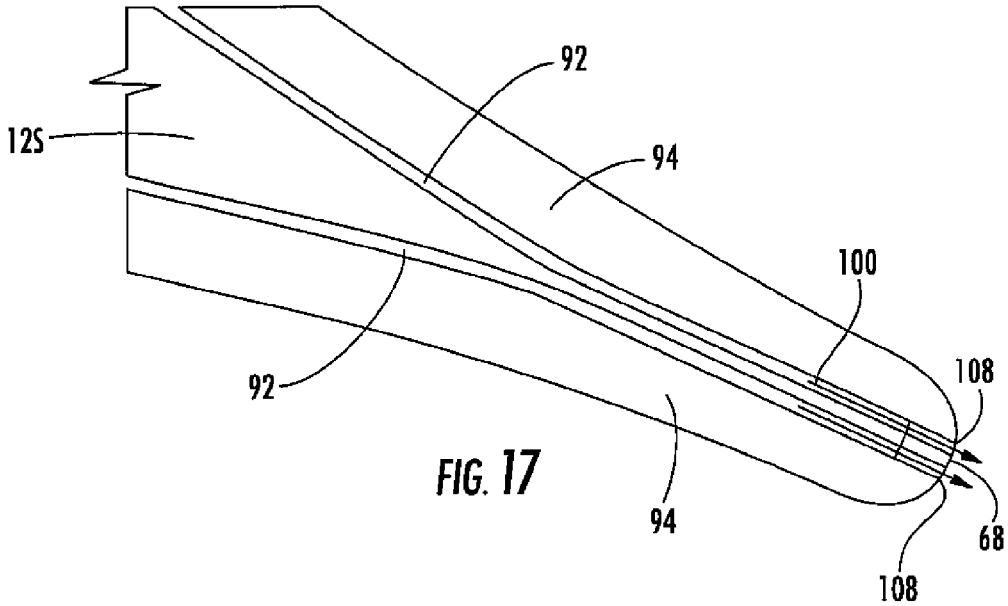
FIG. 17 is close-up view of the trailing edge of the vane in FIG. 16, showing exit passages at the trailing edge of the vane.

The outer covering can be a variety of materials or combinations of materials that can protect the outer peripheral surface 20 of the vane assembly 10. For example, the outer covering can be used to reduce thermal gradients across the CMC laminates 12 or to otherwise afford greater thermal protection for the vane assembly 10. In such case, one or more layers of a thermal insulating material or a thermal barrier coating 94 can be applied around the outside surface 20 of the vane 10, as shown in FIGS. 16-17. The earlier discussion of thermal insulating materials and thermal barrier coatings applies equally here.

Figure 18:
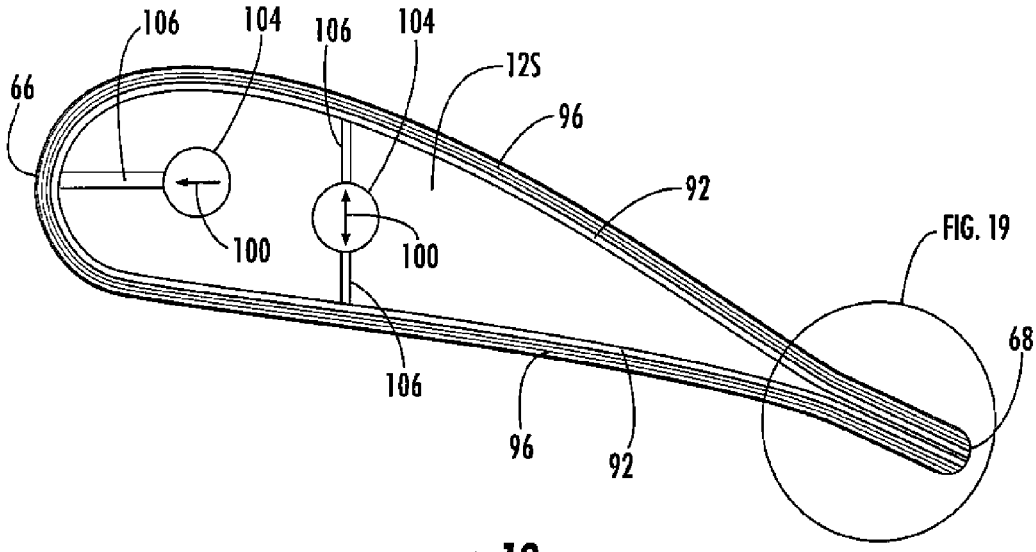
FIG. 18 is a cross-sectional top plan view of a stacked laminate vane according to embodiments of the invention, showing an alternative outer covering cooperating with the stepped outer peripheral surface to form cooling channels about the vane.
Figure 19:
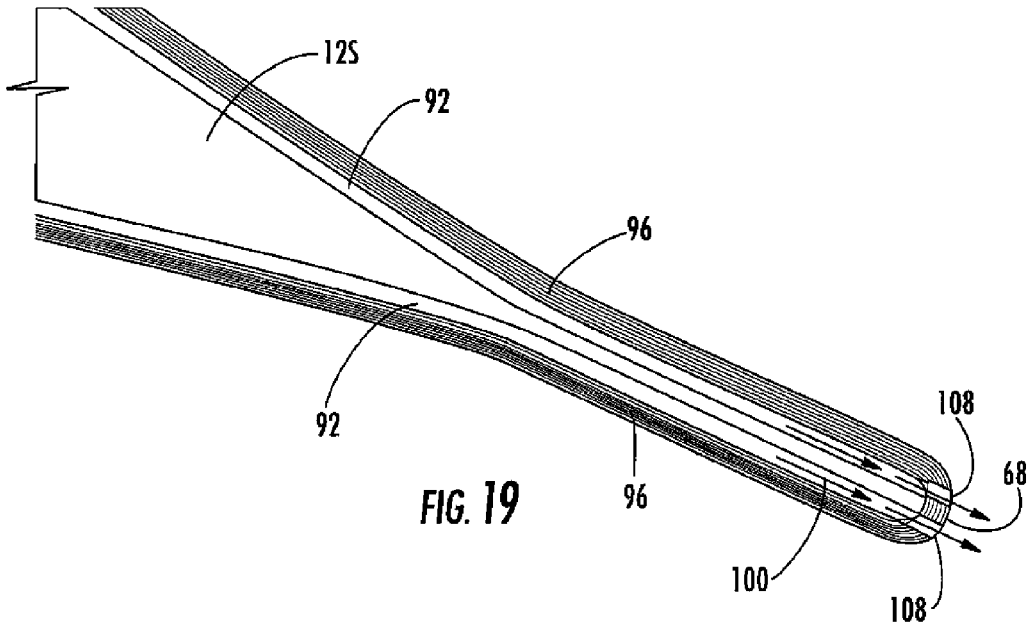
FIG. 19 is close-up view of the trailing edge of the vane in FIG. 18, showing exit passages at the trailing edge of the vane.

In one embodiment, the outer covering can be one or more layers of a CMC wrap 96, as shown in FIGS. 18-19. The CMC wrap 96 can be made of substantially the same CMC material as the laminates 12 or at least the fibers of the CMC wrap 96 can be from the same family of oxide fibers in the CMC laminates 12, particularly in terms of their thermal and shrinkage characteristics. However, CMC materials with dissimilar properties and constructions (for example, a different denier or weave in the fiber fabric) can also be used for the CMC wrap 96.

Figure 20:
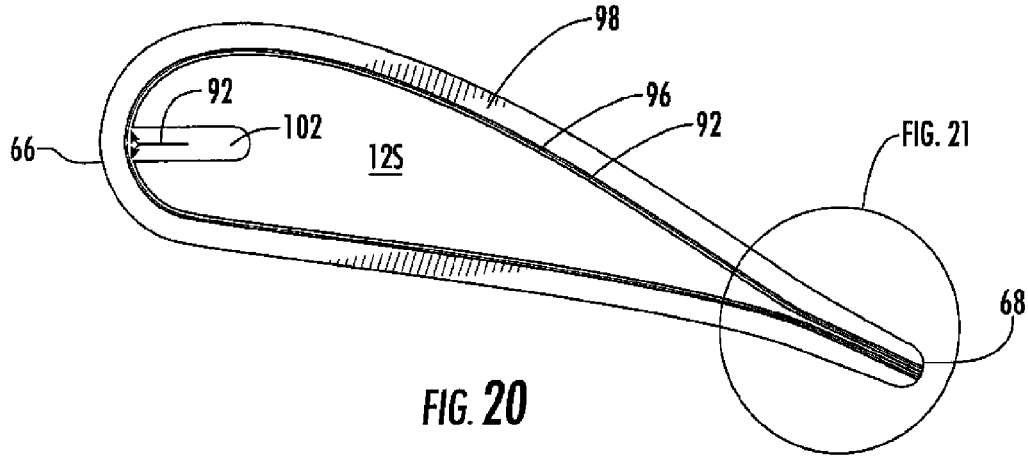
FIG. 20 is a cross-sectional top plan view of a stacked laminate vane according to embodiments of the invention, showing another alternative outer covering cooperating with the stepped outer peripheral surface to form cooling channels about the vane.
Figure 21:
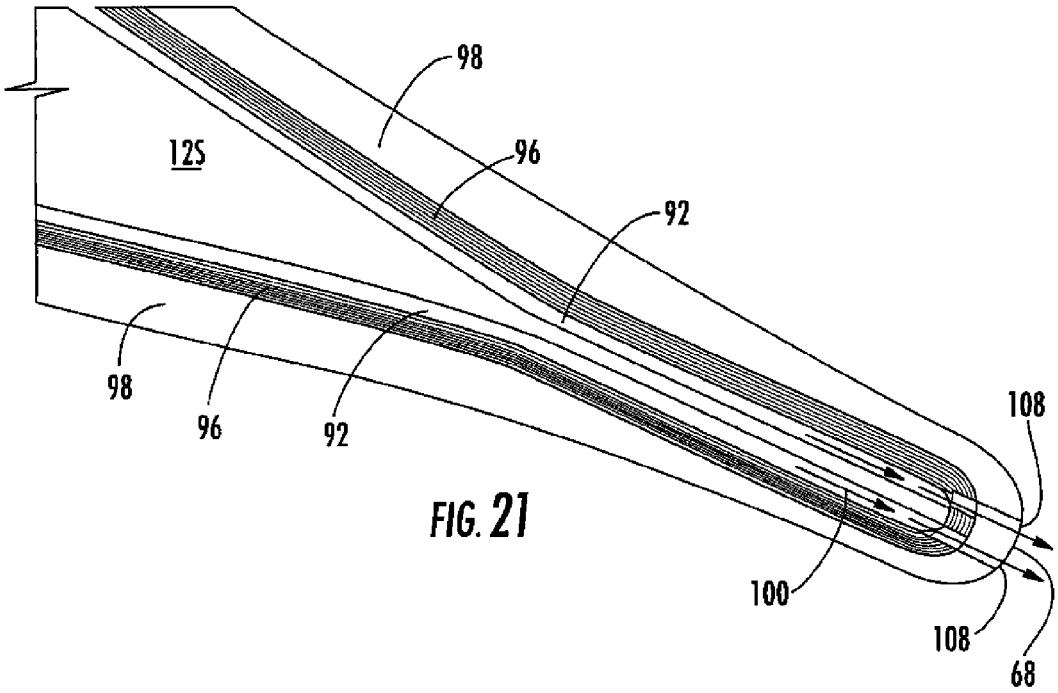
FIG. 21 is close-up view of the trailing edge of the vane in FIG. 20, showing exit passages at the trailing edge of the vane.

In one embodiment, the fibers of the CMC wrap 96 can be substantially aligned in the radial direction 15 of the vane 10. In such case, the fibers of the CMC wrap 96 can be substantially normal to the fiber orientation in the laminates 12. In one embodiment, the CMC wrap 96 can be substantially surrounded by a thermal insulating material or thermal barrier coating 98, as shown in FIGS. 20-21. Additional details of these and other possible outer wraps and the manner in which they cooperate with a solid core CMC vane are described in U.S. Pat. No. 6,709,230, which is incorporated herein by reference.

The coolant passages 92 can be supplied with a coolant 100, such as air, through a supply plenum. In one embodiment, the supply plenum can be formed by providing radial cutouts 102 at or near the leading edge of each laminate 12, as shown in FIG. 16. The coolant supply plenum 102 can be in fluid communication with the plurality of cooling channels 92. Other manners of supplying a coolant 100 to the cooling channels 92 are possible. For example, one or more plenums can be provided in a central location in the laminates 12, such as bolt holes 104 (FIG. 18). Because the small laminates 12S can define one wall of the cooling channels 92, one or more passages 106 can extend in the planar direction 14 of the laminate 12S, connecting the plenum 104 to the cooling channels 92 through the outer peripheral edge 30 of the laminates 12S, as shown in FIG. 18.

Regardless of the particular coolant supply arrangement, a coolant 100 introduced in the supply plenum can flow into the series of cooling channels 92 so as to cool the outer peripheral surface 20 of the vane 10. When the coolant 100 reaches the trailing edge 68, one or more exit passages 108 can be provided through the trailing edge 68 of at least one of the laminates 12 and the outer covering (see, for example, FIGS. 17, 19 and 21). The exit passages 108 can be in fluid communication with a cooling channel 92 in the vane 10. The exit passages 108 can have any of a number of configurations. Preferably, the exit passages 108 are substantially circular. In one embodiment, two trailing edge exit passages 108 can be provided for every cooling passage 92. Such exit passages 108 can be provided by any conventional material removal process, such as drilling. Thus, coolant 100 can be dumped at the trailing edge 68 and enter the turbine gas path.

It will be readily appreciated that the laminates 12 according to embodiments of the invention, generally shown in FIGS. 14-21, can be made by conventional machining techniques, such as laser or water jet cutting.

Embodiments of another cooling system according to aspects of the invention are shown in FIGS. 22-28. In general, each laminate can have a forward portion 70 including the leading edge 66 and an aft portion 72 including the trailing edge 68. At least one of the aft portion 72 and the forward portion 70 of the laminates can be configured with a cooling system according to embodiment of the invention.

To form a trailing edge cooling system, a vane 10 can be formed by a radial stack of alternating laminates. One embodiment of a cooling system for the aft portion 72 of the vane 10, shown in FIGS. 22-23, includes a laminate stack made up of two types of laminates—a first laminate 110 and a second laminate 112.

Figure 28:
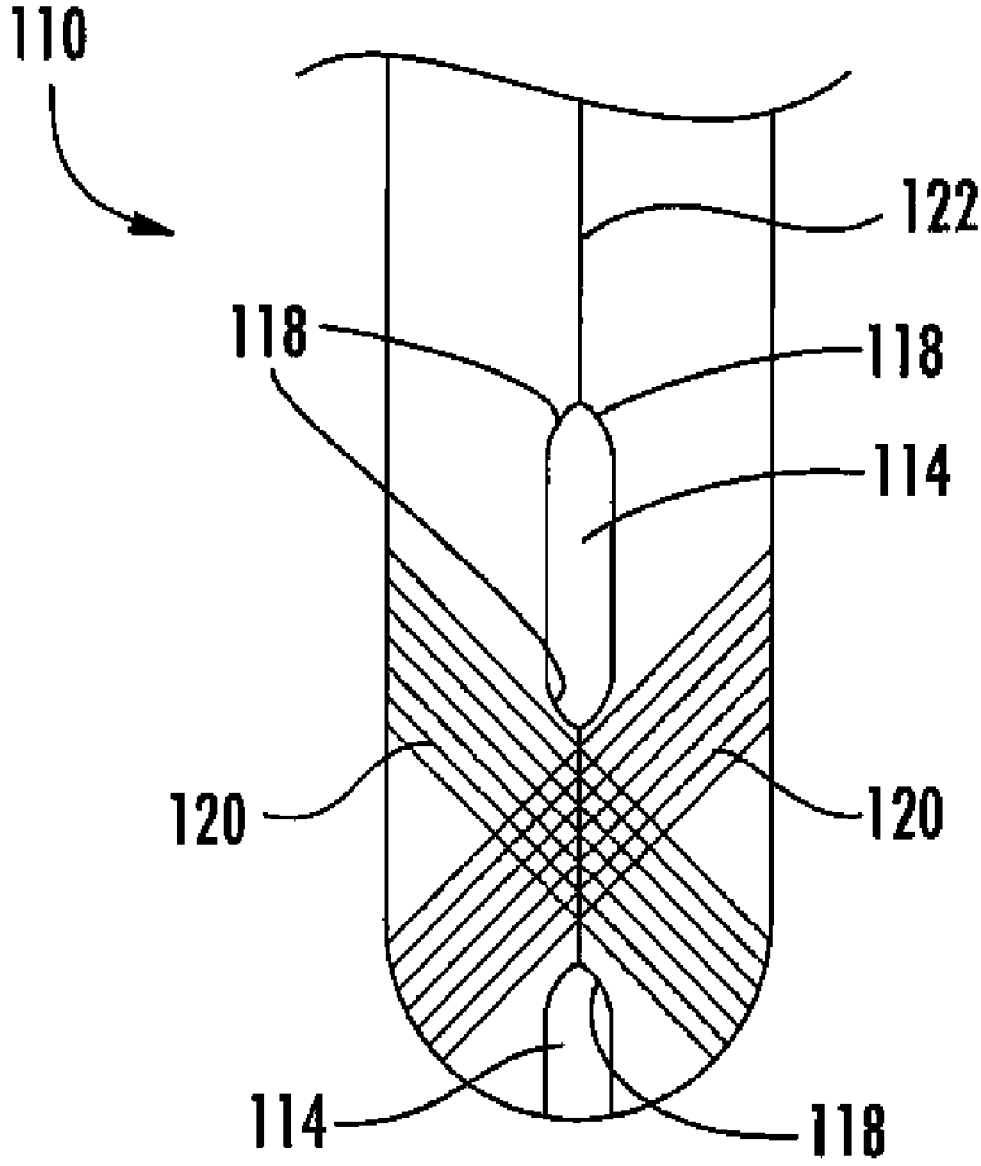
FIG. 28 is a top plan view of a portion of the trailing edge of a laminate according to embodiments of the invention, showing the cooling slots having ends with fillets.

The first laminate 110 can have a series of discrete cooling slots 114 in the aft portion. There can be any number of slots 114 in the series. Each slot 114 can extend through the thickness of the laminate 110 at any of a number of angles, but at substantially 90 degrees to the surface 116 is preferred. The slots 114 can extend toward the trailing edge 68 of the laminate 110. The final slot **114*f* in the series can open to the trailing edge 68. The cooling slots 114 (including the final slot 114*f*) can have any of a number of shapes. For example, the cooling slots 114 can be generally rectangular, but other conformations are possible. The slots 114 can be substantially identical in size and shape, or at least one of the slots 114 can be different in either of these respects. Further, the cooling slots 114 can be shaped to take advantage of the orientation of the fibers in the laminate 110 to minimize the stress concentrations that may develop in slots 114 with sharp corners. To that end, the cooling slots 114 can be formed such that the ends of the slot 114 include fillets 118 that generally follow or substantially correspond to the fiber orientation in the laminate. For example, if the fibers 120 in the laminate 110 are oriented at +/−45 degrees relative to the chord line 122 of the laminate 110, the ends of the cooling slots 114 can include fillets 118 that generally extend at about +/−45 degrees relative to the chord line 122 of the laminate 110, as shown in FIG. 28**.

Figure 22:
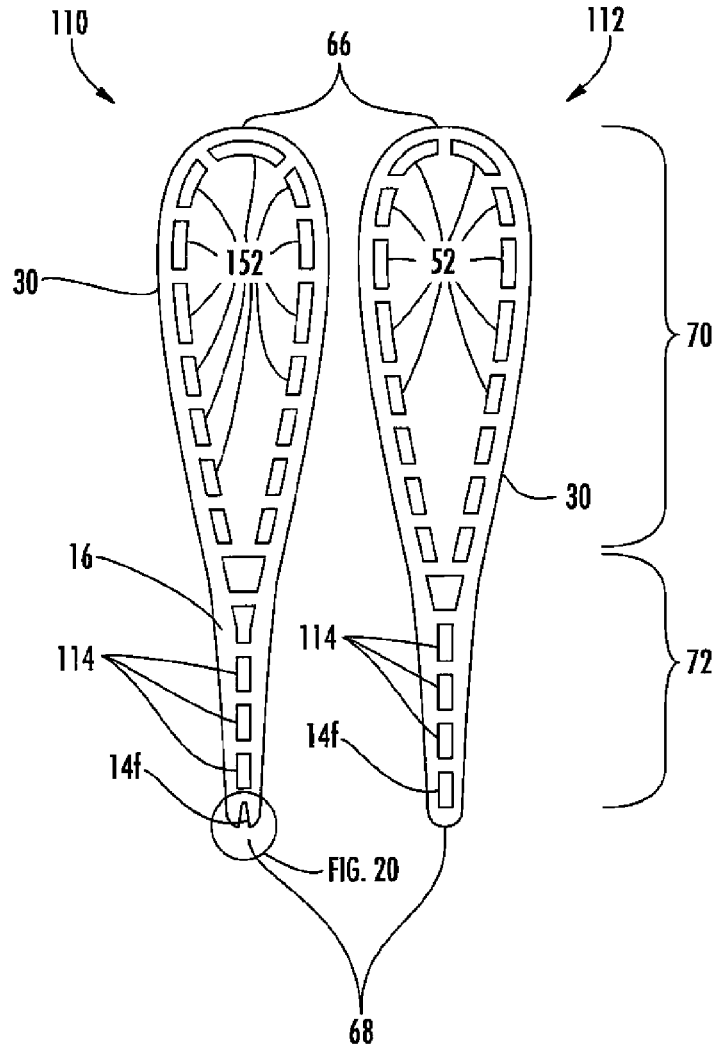
FIG. 22 is an top plan view of two adjacent laminates in a vane stack according to embodiments of the invention, showing a series of cooling slots in each of the laminates.

The slots 114 in each laminate can be substantially equally spaced from each other in the aft portion 72 of the laminate, or they can be unequally spaced. Further, it should be noted that the cooling slots 114 can be arranged in various ways. For instance, the slots 114 can be substantially aligned so as to form a row, as shown in FIG. 22. In some embodiments, there can be more than one row of slots 114. Alternatively, the cooling slots 114 may not be substantially aligned so as to be staggered or otherwise offset. The location of the slots 114 can also vary. For instance, the slots 114 can be centrally disposed in the aft portion 72 of the laminate 110, but they can also be situated closer to one side of the laminate 110. The cooling passages 114 can be formed by any of a number of processes including all of those discussed previously.

The second laminate 112 can also have a series of cooling slots 114 in the aft portion 72 of the laminate 112. The above discussion pertaining to slots 114 in the first laminate 110 is applicable to the slots 114 in the second laminate. However, unlike the final slot **114*f* in the first laminate 110, the final slot 114*f* in the second laminate 112*f* does not open to the trailing edge 68. That is, the final slot 114*f* can terminate prior to and proximate to the trailing edge 68. In addition, at least some of the slots 114 in the second laminate 112 are overlappingly offset from the slots 114 in the first laminate 110, as shown in FIG. 23**.

The first and second laminates 110, 112 can be stacked in an alternating manner to form a vane 10. The previous discussion of "alternate" or "alternating" applies, and the following discussion will assume an ABABAB type arrangement. Thus, when the laminates are stacked, the slots 114 can be overlappingly offset so that the slots 114 in the first laminate 110 are in fluid communication with the slots 114 in the second laminate 112. In one embodiment, shown in FIG. 24, each cooling slot 114 in one laminate can be in fluid communication with two cooling slots 114 in each adjacent laminate. However, the last slot **114*f* of the first laminate 110 is in fluid communication with only the final slot 114***f* of each adjacent second laminate 112. This network of cooling slots 114 can create a tortuous fluid path out the trailing edge 68 of the vane assembly 10. In order to exit the vane assembly 10, a coolant supplied to the vane 10 must move in the planar and radial directions 14, 15 to exit out the trailing edge 68 through the final passage 114*f* in the first laminate 110. Thus, the laminates 110, 112 can create a pin-fin cooling array.

Figure 24:
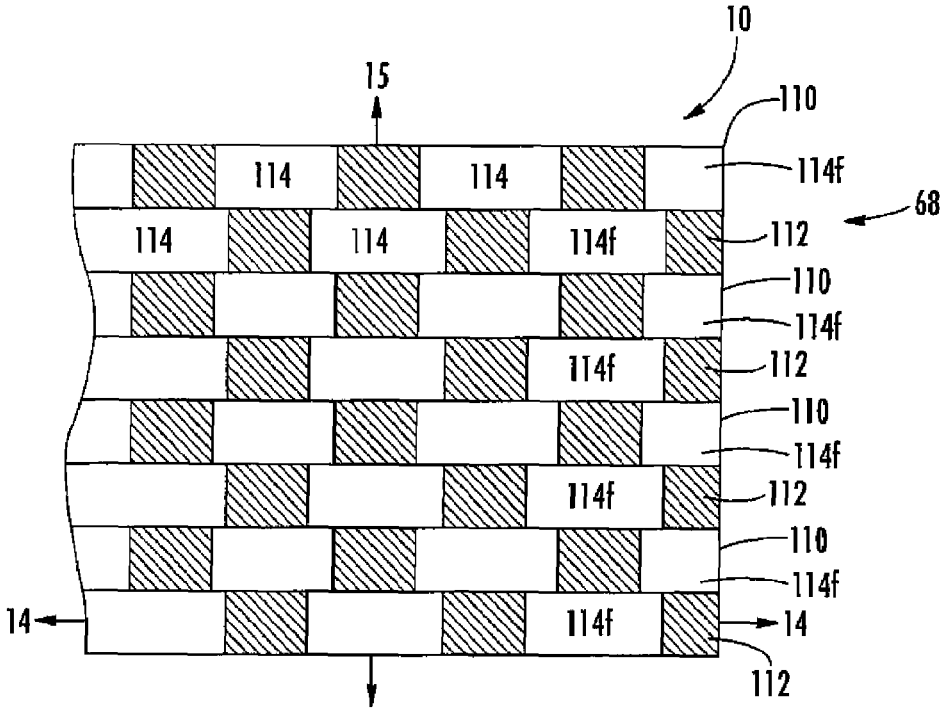
FIG. 24 is a cross-sectional view of the trailing edge of a laminate stack according to embodiments of the invention, taken along line 24-24 in FIG. 23, showing a first cooling path formed by the laminates.
Figure 25:
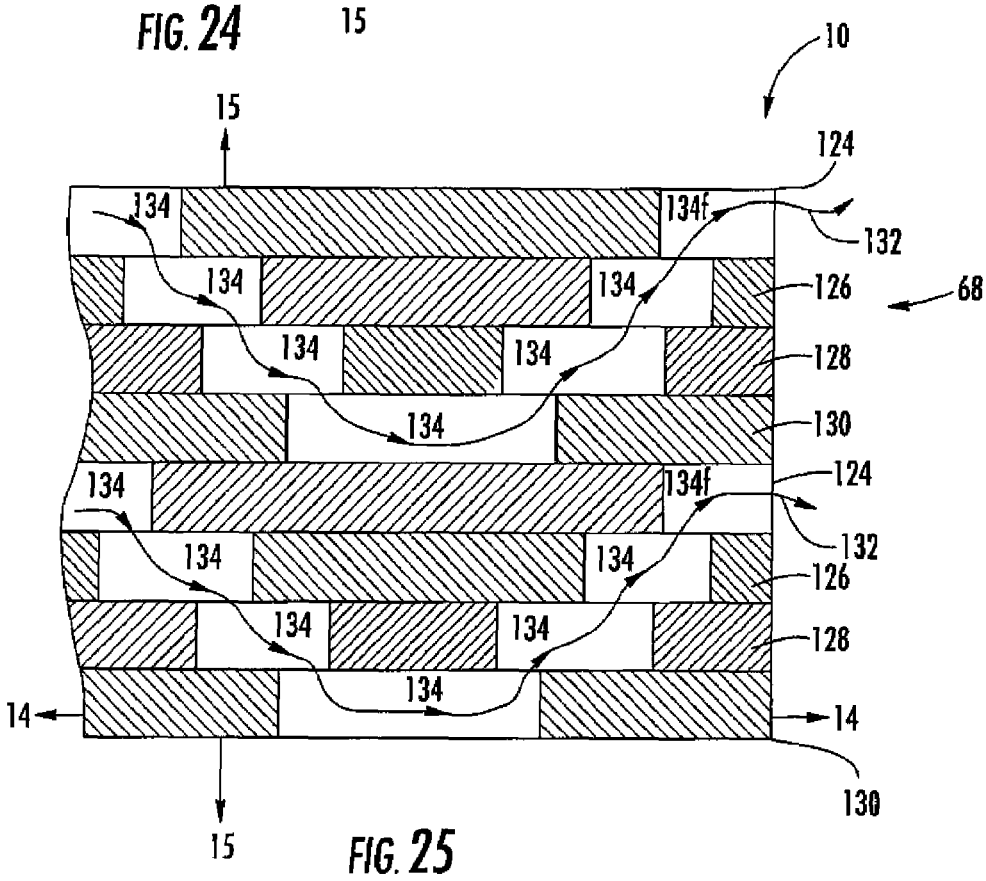
FIG. 25 is a cross-sectional view of the trailing edge of a laminate stack according to embodiments of the invention, taken along line 25-25 in FIG. 23, showing an alternative cooling path formed by the laminates.

The arrangement shown in FIG. 24 is merely one example of numerous cooling schemes that are possible according to embodiments of the invention. The system shown in FIG. 24 is also an example of a system formed by a stack of only two laminate designs 110, 112. Embodiments of the invention are not limited a cooling path using only two types of laminates. It will be appreciated that the any number of laminate designs and cooling slots can be arranged in a variety of ways to optimize cooling of the aft portion 72 of the vane assembly 10.

Figure 23:
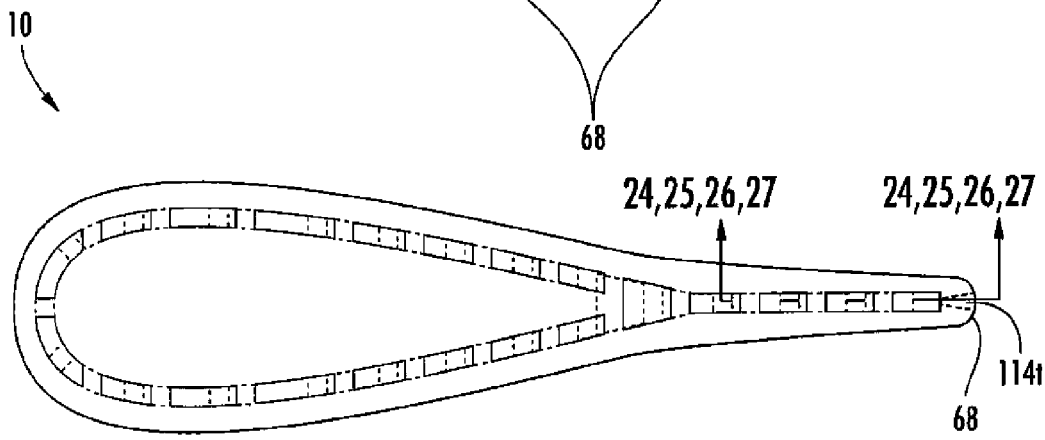
FIG. 23 is a top plan view of a vane formed by stacking the laminates shown in FIG. 22 according to embodiments of the invention.

For example, FIG. 23 shows an arrangement of four adjacent airfoil laminates—a first laminate 124, a second laminate 126, a third laminate 128 and a fourth laminate 130—that can cooperate to form a path that forces the coolant 132 to move in an undulating manner in the planar direction 14 and the radial direction 15 before exiting through cooling slots 134*f* that open to the trailing edge 68. The cooling slots 134 in one laminate can overlappingly offset the cooling slots 134 of an adjacent laminate. Each cooling slot 134 can be in fluid communication with one cooling slot 134 in an adjacent laminate. Further, it should be noted that the laminates 124, 126, 128, 130 can be configured so as to create a plurality of compartmentalized cooling paths through the aft portion 72 of the vane assembly 10.

Figure 26:
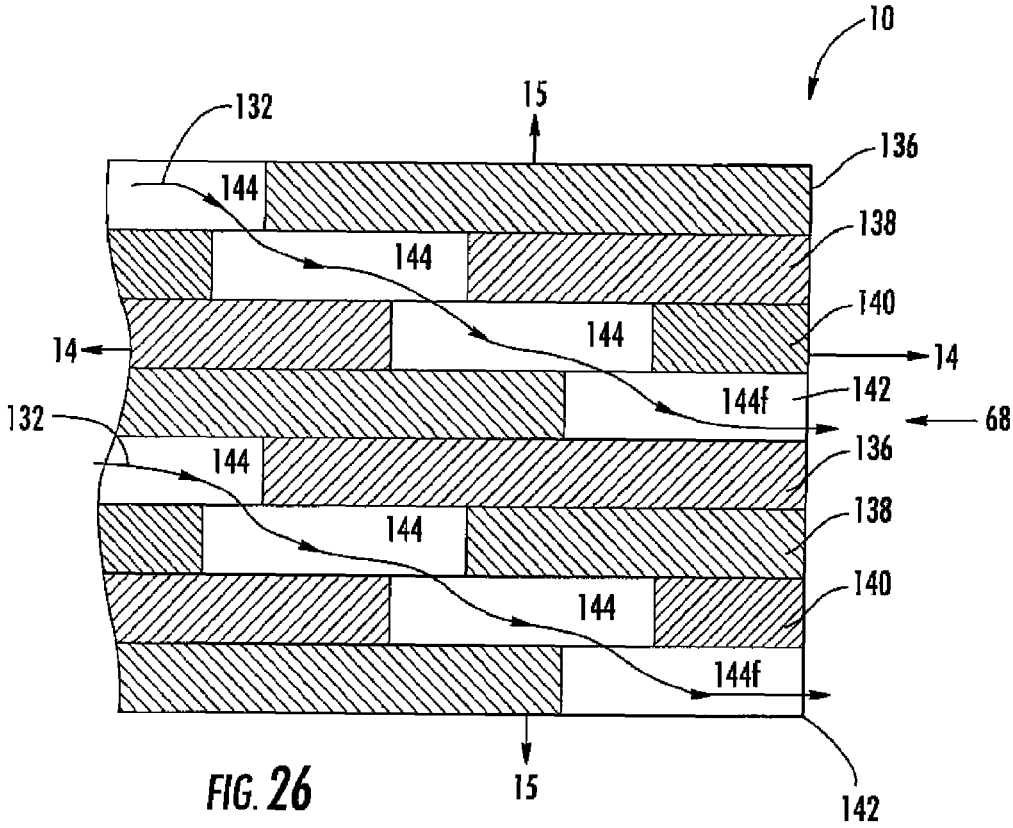
FIG. 26 is a cross-sectional view of the trailing edge of a laminate stack according to embodiments of the invention, taken along line 26-26 in FIG. 23, showing a second alternative cooling path formed by the laminates.

Another embodiment of a cooling system according to embodiments of the invention is shown in FIG. 26. The cooling system can be formed by a cooperation of four laminates—a first laminate 136, a second laminate 138, a third laminate 140 and a fourth laminate 142. In this embodiment, the arrangement of the laminates 136, 138, 140, 142 can force the coolant 132 to move in diagonally through the vane assembly 10 to trailing edge exit slots 144*f* The cooling slots 144 in one laminate can overlappingly offset the cooling slots 144 of an adjacent laminate. Each cooling slot 144 can be in fluid communication with one cooling slot 144 in an adjacent laminate. Again, a plurality of compartmentalized cooling paths are achieved by a strategic configuration of the laminates 136, 138, 140, 142.

Figure 27:
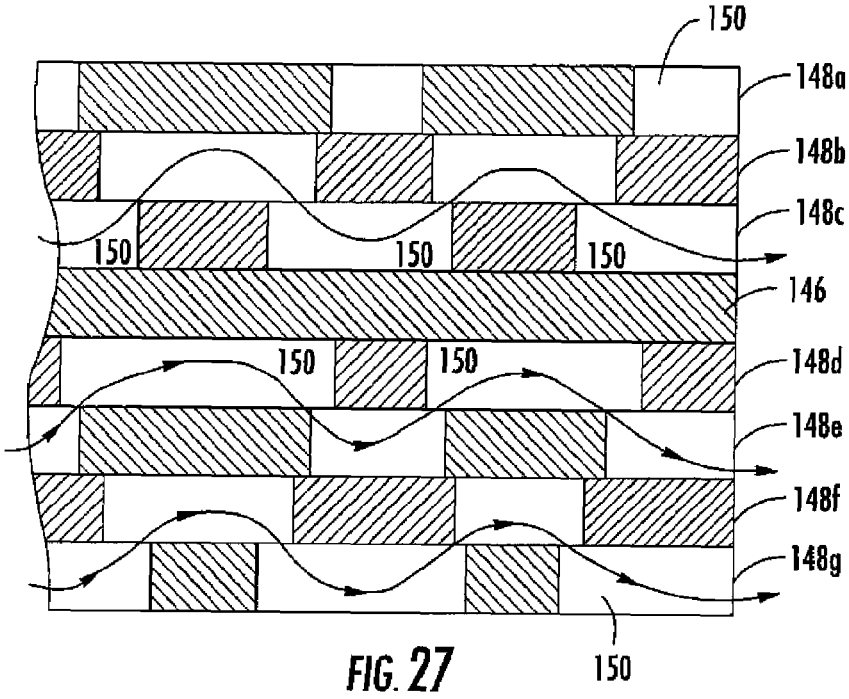
FIG. 27 is a cross-sectional view of the trailing edge of a laminate stack according to embodiments of the invention, taken along line 27-27 in FIG. 23, showing a third alternative cooling path formed by the laminates.

In some instances, the multiple cooling paths in a vane assembly pattern can be compartmentalized by using one or more solid laminates 146 without any slots, as shown in FIG. 27. Such solid laminates 146 can be thinner than the other laminates 148*a*, 148*b*, 148*c*, 148*d*, 148*e*, 148*f*, 148*g* with slots 150 to improve cooling because the solid laminate 146 will be mostly cooled through interaction with the slots 150 in the adjacent laminates 148*c*, 148*d*.

While the described in connection with the aft portion 72 of the vane 10, any of the foregoing overlappingly offset cooling slot systems can be applied to the forward portion 70 of the vane 10 as well. For instance, as shown in FIG. 22, a series of cooling slots 152 can be provided in the forward portion 70 of the first laminate 110 proximate to and generally following the contour of the outer peripheral surface 30. Likewise, a series of cooling slots 152 can be provided in the forward portion 70 of the second laminate 112 proximate to the outer peripheral surface 30. Thus, as can been seen in FIG. 23, the cooling slots 152 are overlappingly offset such that each slot 152 in the first laminate 110 is in fluid communication one or more slots 152 in the second laminate 112. Again, a tortuous path is created such that a coolant must move in the planar and radial directions through the forward portion 70 of the vane 10. It will be understood that any of a number of overlappingly offset cooling systems can be used in the forward portion 70 of the vane 10 including all of those shown in FIGS. 24-27.

The foregoing description is provided in the context of one vane assembly according to embodiments of the invention. Of course, aspects of the invention can be employed with respect to myriad vane designs, including all of those described above, as one skilled in the art would appreciate. Embodiments of the invention may have application to other hot gas path components of a turbine engine. Thus, it will of course be understood that the invention is not limited to the specific details described herein, which are given by way of example only, and that various modifications and alterations are possible within the scope of the invention as defined in the following claims.

What is claimed is:

1. A cooled vane assembly comprising:

a vane formed by a radial stack of laminates having an airfoil-shaped outer periphery, the vane having a planar direction and a radial direction, the radial direction being substantially normal to the planar direction, wherein each of the laminates is made of an anistropic CMC material such that the planar tensile strength of the vane is substantially greater than the radial tensile strength of the vane;

at least one of the laminates having a outer airfoil-shaped wall enclosing an inner wall, the inner wall being spaced from the outer wall so as to define a cooling passage therebetween, the inner wall being connected to the outer wall by at least one rib, wherein the at least one rib divides the cooling passage into a set of discrete cooling passage, the inner wall enclosing a central opening defining a plenum;

a second laminate having an outer airfoil-shaped wall enclosing an inner wall, the inner wall being spaced from the outer wall so as to define a cooling passage therebetween, the inner wall being joined to the outer wall by least one rib, wherein the at least one rib divides the cooling passage into a set of discrete cooling passages, the inner wall including a central opening defining a plenum;

wherein the vane is formed by an alternating arrangement of the at least one laminate and the second laminate, and wherein the cooling passages in the at least one laminate offsettingly overlap the cooling passages in the second laminate so as to be in fluid communication.

2. The vane assembly of claim 1 wherein the plenum is in fluid communication with at least one of the cooling passages through at least one supply opening provided in the inner wall.

3. The vane assembly of claim 2 wherein the at least one laminate has a leading edge and a trailing edge, wherein the supply opening is provided near one of the trailing edge and the leading edge of the laminate.

4. The vane of claim 1 wherein the spacing between the outer and inner walls in the at least one laminate is substantially constant.

5. The vane assembly of claim 1 wherein at least one he laminates includes a forward portion and an aft portion, wherein the spacing between the outer and inner walls is substantially constant in the forward portion and increases in at least a part of the aft portion, whereby at least one he laminates includes a substantially hollow trailing edge.

6. The vane of claim 1 wherein at least one he laminates includes a discharge opening extending through the outer wall of at least one he laminates substantially in the planar direction, wherein the discharge opening extends from one of the cooling passages and out the trailing edge of at least one he laminates, whereby a coolant in the cooling passages can be discharged at the trailing edge of the vane.

7. The vane assembly of claim 1 wherein the vane includes an outer peripheral surface, wherein the outer peripheral surface is substantially covered by a thermal insulating material.

8. The vane assembly of claim 1 wherein vane includes a pressure side and a suction side, wherein the at least one rib is provides only on the suction side of the at least one laminate.

* * * * *